US010276926B2

(12) United States Patent
Cwik et al.

(10) Patent No.: US 10,276,926 B2
(45) Date of Patent: Apr. 30, 2019

(54) DEPLOYABLE REFLECTARRAY ANTENNA

(71) Applicant: California Institute of Technology, Pasadena, CA (US)

(72) Inventors: Thomas A. Cwik, Pasadena, CA (US); Nacer E. Chahat, Pasadena, CA (US); Jonathan Sauder, Pasadena, CA (US); Manan Arya, Pasadena, CA (US); Ellen Thiel, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 0 days.

(21) Appl. No.: 15/850,861

(22) Filed: Dec. 21, 2017

(65) Prior Publication Data

US 2018/0254547 A1 Sep. 6, 2018

Related U.S. Application Data

(60) Provisional application No. 62/443,479, filed on Jan. 6, 2017.

(51) Int. Cl.

| | |
|---|---|
| ***H01Q 1/08*** | (2006.01) |
| ***H01Q 1/28*** | (2006.01) |
| ***H01Q 1/10*** | (2006.01) |
| ***H01Q 19/18*** | (2006.01) |
| ***H01Q 15/14*** | (2006.01) |
| ***H01Q 3/06*** | (2006.01) |
| ***H01Q 13/02*** | (2006.01) |
| ***H01Q 3/46*** | (2006.01) |
| ***H01Q 15/16*** | (2006.01) |
| ***H01Q 19/08*** | (2006.01) |
| ***H01Q 19/10*** | (2006.01) |

(52) U.S. Cl.

CPC ..... *H01Q 1/288* (2013.01); *H01Q 1/08* (2013.01); *H01Q 1/10* (2013.01); *H01Q 3/06* (2013.01); *H01Q 3/46* (2013.01); *H01Q 13/02* (2013.01); *H01Q 15/145* (2013.01); *H01Q 15/161* (2013.01); *H01Q 19/08* (2013.01); *H01Q 19/104* (2013.01); *H01Q 19/18* (2013.01)

(58) Field of Classification Search

CPC .. H01Q 1/28; H01Q 1/08; H01Q 1/10; H01Q 3/06; H01Q 3/46; H01Q 13/02; H01Q 15/14; H01Q 15/16; H01Q 19/08; H01Q 19/10; H01Q 19/18

USPC ..... 343/837

See application file for complete search history.

(56) References Cited

U.S. PATENT DOCUMENTS

2016/0197394 A1* 7/2016 Harvey ..... H01Q 1/1235 343/837

OTHER PUBLICATIONS

Boshuizen, C. et al., "Results from the Planet Labs Flock Constellation", 28th Annual AIAA/USA Conference on Small Satellites, pp. 1-8, (Aug. 2014). 9 pages.

(Continued)

*Primary Examiner* — Andrea Lindgren Baltzell

(74) *Attorney, Agent, or Firm* — Steinfl + Bruno LLP

(57) ABSTRACT

A deployable reflectarray antenna stowable in a 6U CubeSat volume is deployed through tape deployers and quartz cables. The telescoping waveguide is attached to the horn with a threaded insert. The reflectarray antenna has, at 37.75 GHz, a directivity of 48.5 dBi, a gain of 47.8 dBi, and an aperture efficiency of 42%. Hinges with a ball-end screw enable precise control of deployment angle of adjacent panels in the reflectarray antenna.

17 Claims, 36 Drawing Sheets

(56) References Cited

OTHER PUBLICATIONS

Chahat, N. et al., "1.9-THz Multiflare Angle Horn Optimization for Space Instruments," IEEE Transactions on Terahertz Science and Technology, vol. 5, No. 6, pp. 914-921, (Nov. 2015). 9 pages.
Chahat, N. et al., "CubeSat Deployable Ka-Band Mesh Reflector Antenna Development for Earth Science Missions,"IEEE Transactions on Antennas and Propagation, vol. 64, No. 6, pp. 2083-2093, (Jun. 2016). 12 pages.
Chahat, N. et al., "The Deep-Space Network Telecommunication CubeSat Antenna-Using the deployable Ka-band mesh reflector antenna," IEEE Antenna Propag. Magazine, under review, (2016). 9 pages.
Hodges, R.E. et al., "The Mars Cube One Deployable High Gain Antenna," IEEE Antenna Propag. Magazine, under review, (2016). 3 pages.
Peral, E. et al., "RainCube: a Proposed Constellation of Precipitation Profiling Radars in CubeSat," AGU Fall Meeting, San Francisco, (Dec. 2014). 5 pages.
Hodges, R.E. et al., "Novel Deployable Reflectarray Antennas for CubeSat Communications," IEEE MTT-S International Microwave Symposium (IMS), Phoenix, AZ., (2015). 4 pages.
Underwood, C. et al., "Using CubeSat/Micro-Satellite Technology to Demonstrate the Autonomous Assembly of a Reconfigurabie Space Telescope (AARest)", Acta Astronautical 114, pp. 112-122, (Apr. 2015). 12 pages.

* cited by examiner

DEPLOYABLE REFLECTARRAY ANTENNA

CROSS REFERENCE TO RELATED APPLICATIONS

The present application claims priority to U.S. Provisional Patent Application No. 62/443,479, filed on Jan. 6, 2017, the disclosure of which is incorporated herein by reference in its entirety.

STATEMENT OF INTEREST

The invention described herein was made in the performance of work under a NASA contract NNN12AA01C, and is subject to the provisions of Public Law 96-517 (35 USC 202) in which the Contractor has elected to retain title.

TECHNICAL FIELD

The present disclosure relates to antennas. More particularly, it relates to the radiofrequency profile and mechanical deployment of a one meter deployable reflectarray antenna.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

SUMMARY

Figure 1:
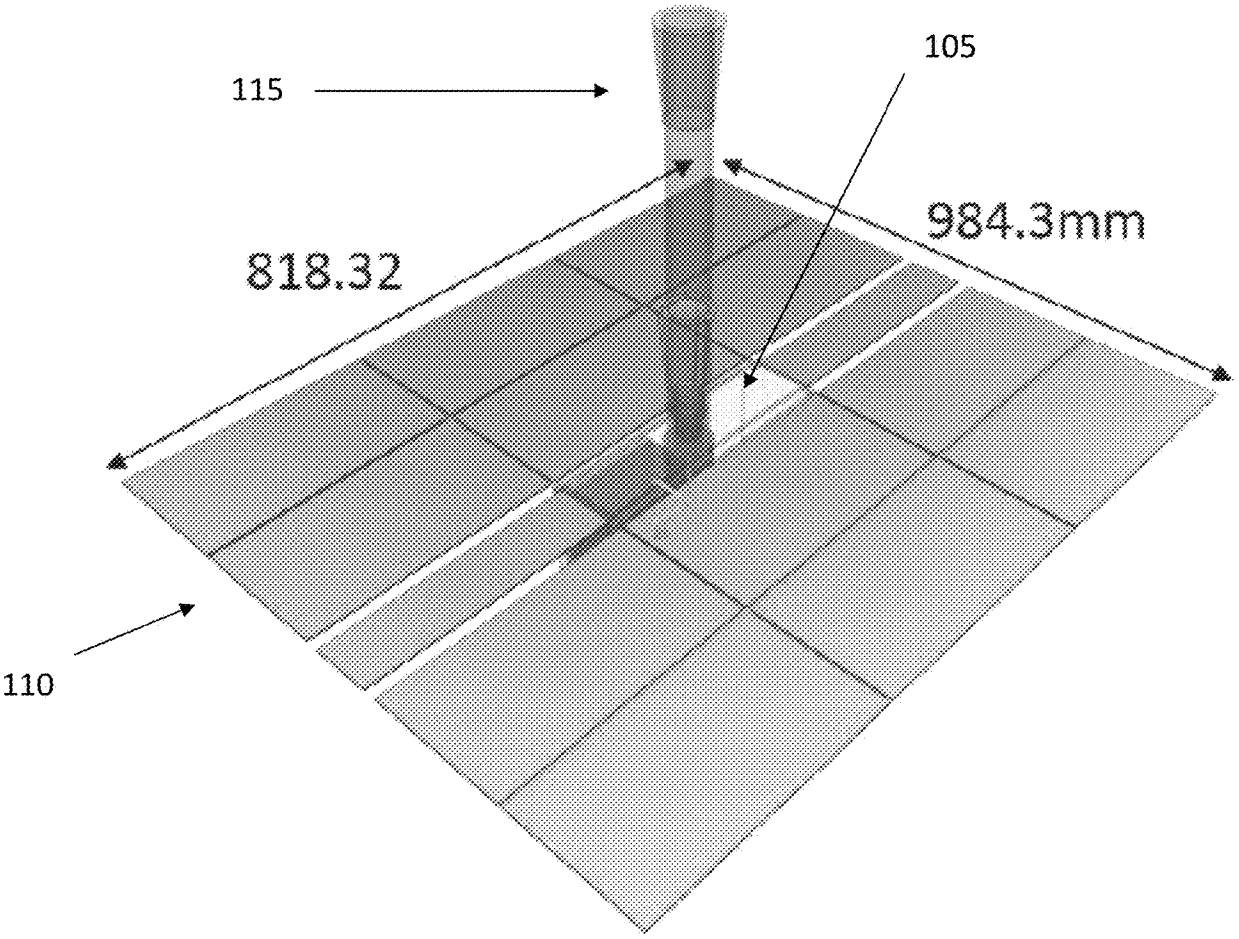
FIG. 1 illustrates an antenna deployed from assembly.

In a first aspect of the disclosure, a structure is described, the structure comprising: a housing; a plurality of reflectarray panels configured to deploy from a folded position to a deployed position, the deployed position for the reflectarray panels forming a reflectarray antenna; a telescoping waveguide comprising at least a first telescoping waveguide section, and a second telescoping waveguide section configured to extend away from the first telescoping waveguide section; a horn attached to the telescoping waveguide by a threaded insert, the horn comprising curved slots; a subreflector attached to the horn by a plurality of struts bonded to a collar on a top portion of the horn; at least one tape deployer driving deployment of the telescoping waveguide, horn and subreflector by extending tape through the curved slots; and at least one cable configured to control positioning of the telescoping waveguide, horn and subreflector during deployment.

DETAILED DESCRIPTION

The present disclosure describes a deployable reflectarray antenna. In some embodiments, the present disclosure describes a 1-meter deployable reflectarray antenna which is designed to fit in a volume of 6U ($10\times20\times30$ cm$^3$) class CubeSats. In some embodiments, the antenna operates at 35.75 GHz for the measurement of atmospheric processes over a short, evolutionary timescale. In some embodiments, the antenna deploys into a 98.6 cm×82.1 cm flat reflector, and can provide a gain of 48.0 dBi and an aperture efficiency of 44%. In some embodiments, the antenna comprises a Cassegrain reflectarray using 14 deployable panels, one fixed panel, a telescoping feed and a telescoping subreflector.

Small spacecraft offer large opportunities for a range of scientific observation of Earth, telecommunications, remote sensing, imaging and other applications. The small volume and mass of the space systems allows frequent and low-cost access to space through ride-along launches with other larger manifested spacecraft, as well as single purpose launches where the cost is distributed among many small spacecraft. Smaller, single-purpose launch systems being developed may expand the field even more.

The application of commercial space electronics and standardized spacecraft bus subsystems has also been very advantageous. Small spacecraft for deep space and planetary exploration are similarly being developed, though the cadence is less than Earth-orbiting systems due to limited deep space launch opportunities.

An outstanding need associated with small spacecraft is a radio frequency (RF) or optical aperture antenna that is commensurate with the scale of the overall space system. For Earth observing systems, solid optical apertures that fit into small satellites without deployment are in regular use meeting a range of requirements (see Ref. [1]). Additional research continues for larger deployed optical apertures (see Ref. [2]). Radio frequency apertures that will produce high gain for telecommunications applications are currently under development (see Refs. [3-7]). These radio frequency apertures can produce narrow beamwidths for Earth science needs. Apertures that will be larger than the bus dimensions are deployed after launch, for example with folding panels which unfold once a satellite is in orbit. Parameters driving the design of deployable antennas are precision of the antenna deployment, relative to the frequency of operation, and the stowed volume during launch. Additional system efficiency can also be considered, such as aperture dimensions. In fact, if the aperture is increased excessively, several issues can manifest, such as pointing, thermal, and other issues that can make the small spacecraft impractical, by increasing cost and accommodation of the spacecraft system within the launch vehicle.

In some embodiments, the present disclosure describes an approach for an RF deployed aperture comprising a reflectarray antenna where the panels are held against the side of the spacecraft bus during launch, and deployed with a hinged system on-orbit. The flat, two-dimensional reflectarray antenna geometry negates the additional volume needed for deployed parabolic or other conic three-dimensional surfaces of a traditional aperture antenna. Since the reflectarray panels are stowed in a flat configuration against the side of the spacecraft during launch, the antenna requires a reduced stowage volume, reducing overall launching costs. The panels can subsequently be deployed when the spacecraft is in orbit, forming the reflectarray antenna. In some embodiments, a hinged system is used for deployment of the folded panels. The hinges need to be designed so that the precision of the deployment is sufficient to enable the operation of the reflectarray within assigned parameters.

The reflectarray panels can be fabricated to meet on-orbit thermal demands and dynamic requirements during launch, providing the necessary deployed precision when coupled with appropriate hinges connecting the panels. A release mechanism can enable the panels to deploy on orbit. In some embodiments, it is also possible to integrate solar panels with the folding antenna panels, for example on the opposite side of the antenna surface. A first application of this approach integrated solar panels with the reflectarray antenna (ISARA) operating in the Ka-band. By combining the two functions, it is possible to obtain mass and volume reductions when compared to having the two systems realized at separate locations in the spacecraft, see Ref. [7]. In other embodiments, the antenna may operate at other bands, such as the X-band. For example, an X-band reflectarray deployed from a 6U cubesat is to be jointly launched with the NASA InSIGHT Mars lander mission and to provide auxiliary telecommunications during the entry descent and landing portion of that mission, see Ref. [6]. In some embodiments, the deployable panels can be used at lower frequencies or higher frequencies than the Ka-band. For example, the W-band may be used. The feed can be modified to operate at the frequency range of interest, as understood by the person of ordinary skill in the art.

FIG. 1 illustrates an antenna deployed from assembly, the antenna fitting in a 6U (10×20×30 $cm^3$) spacecraft. FIG. 1 illustrates the feed (115) and the panels (110). The reflectarray panel in the center (105) is not shown, to render visible the internal bus volume. Table 1 lists several reflectarray data and parameters for an exemplary embodiment. In some embodiments, the lateral dimensions of the reflectarray can be 818.32 mm by 984.3 mm. In other embodiments, the dimensions can be 922.5 mm by 1049.2 mm.

Figure 2:
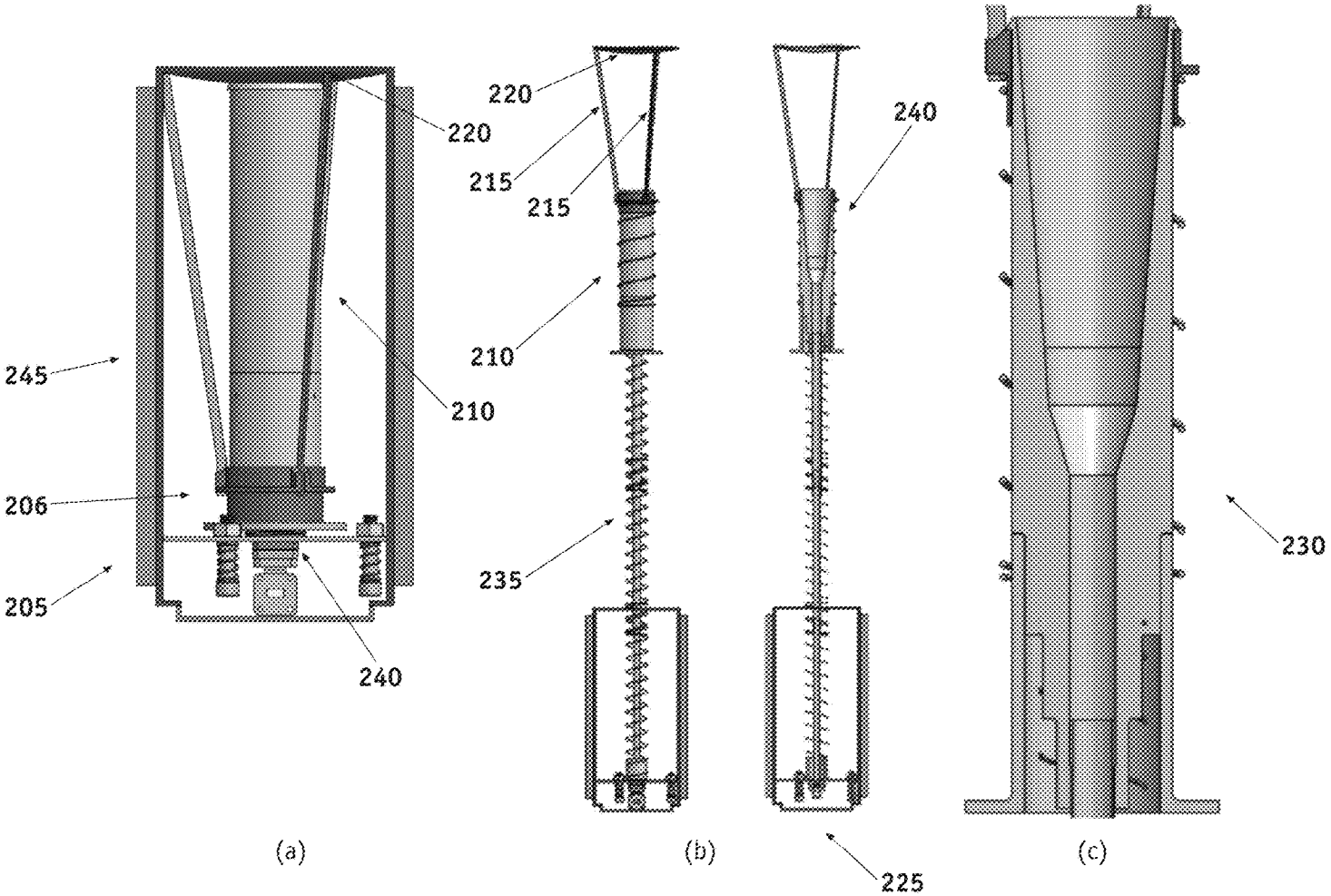
FIG. 2 illustrates an antenna feed in the stowed and deployed configurations.

FIG. 2 illustrates the antenna folded within the spacecraft in panel (a) (205). FIG. 2 illustrates, in panel (b), the deployed feed and sub reflector (225). In particular, the horn (210), the struts (215) and the subreflector (220) are illustrated. The struts connect the subreflector to the horn. As visible in FIG. 2, the horn extends away from the spacecraft along the tubular support with a spring providing the necessary extension force (235). The subreflector also extends away from the horn in the deployed configuration, compared to the stowed configuration. Panel (b) illustrates an external view of the horn (within the cylindrical housing) as well as a cutout view of the horn within the housing (240). In this embodiment, the feed consists of a multiflare horn and three telescoping waveguides. The three telescoping waveguides extend away and form the tubular support in FIG. 2 (in this embodiment, the three telescoping waveguides are of equal length. In FIG. 2, the waveguides are within the horn in the stowed configuration of panel (a). In some embodiments, springs provide the extension force to deploy the waveguides, horn and subreflector.

Figure 3:
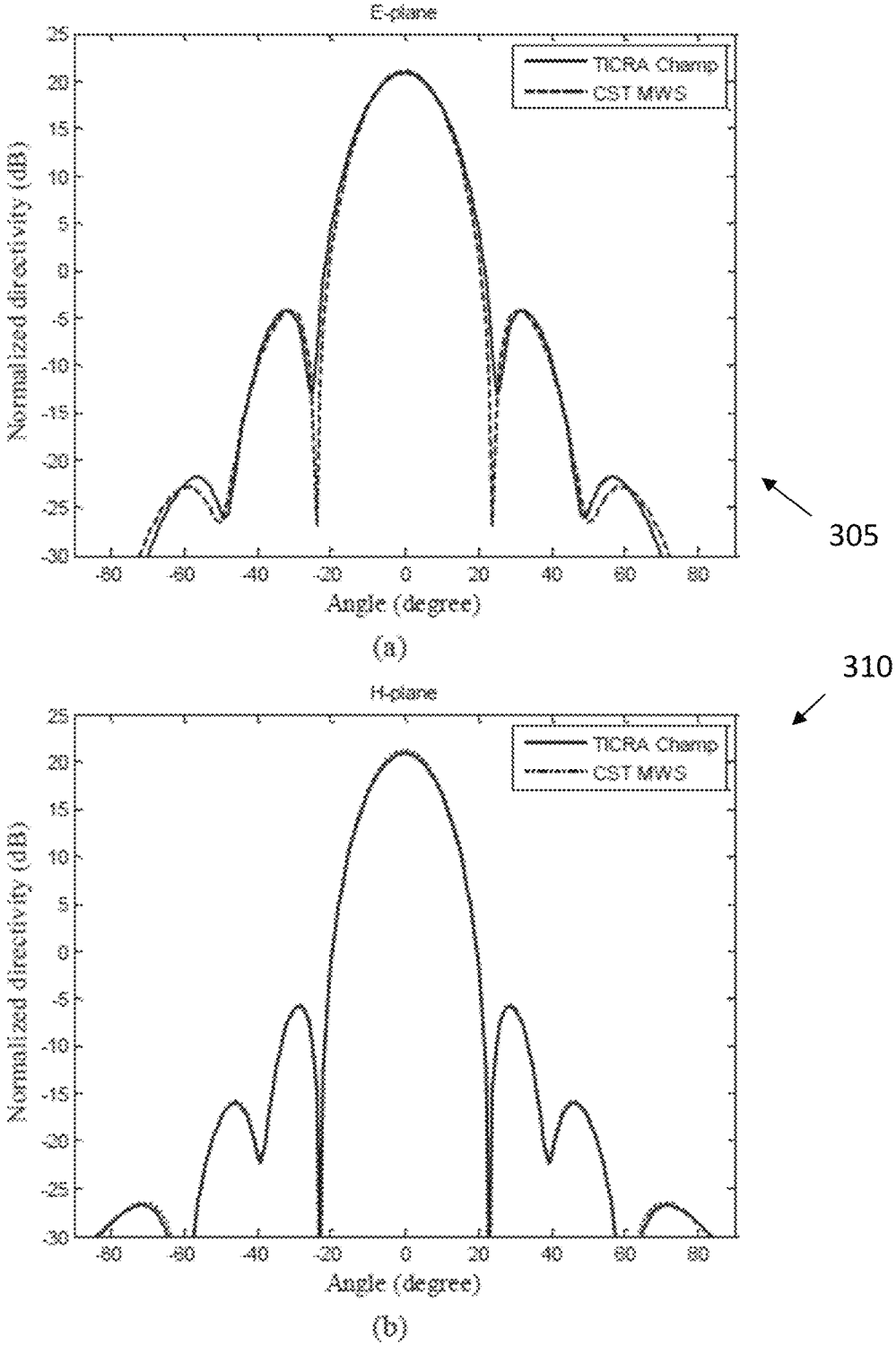
FIG. 3 illustrates the radiation pattern of one embodiment of the optimized multiflare horn feed.
Figure 4:
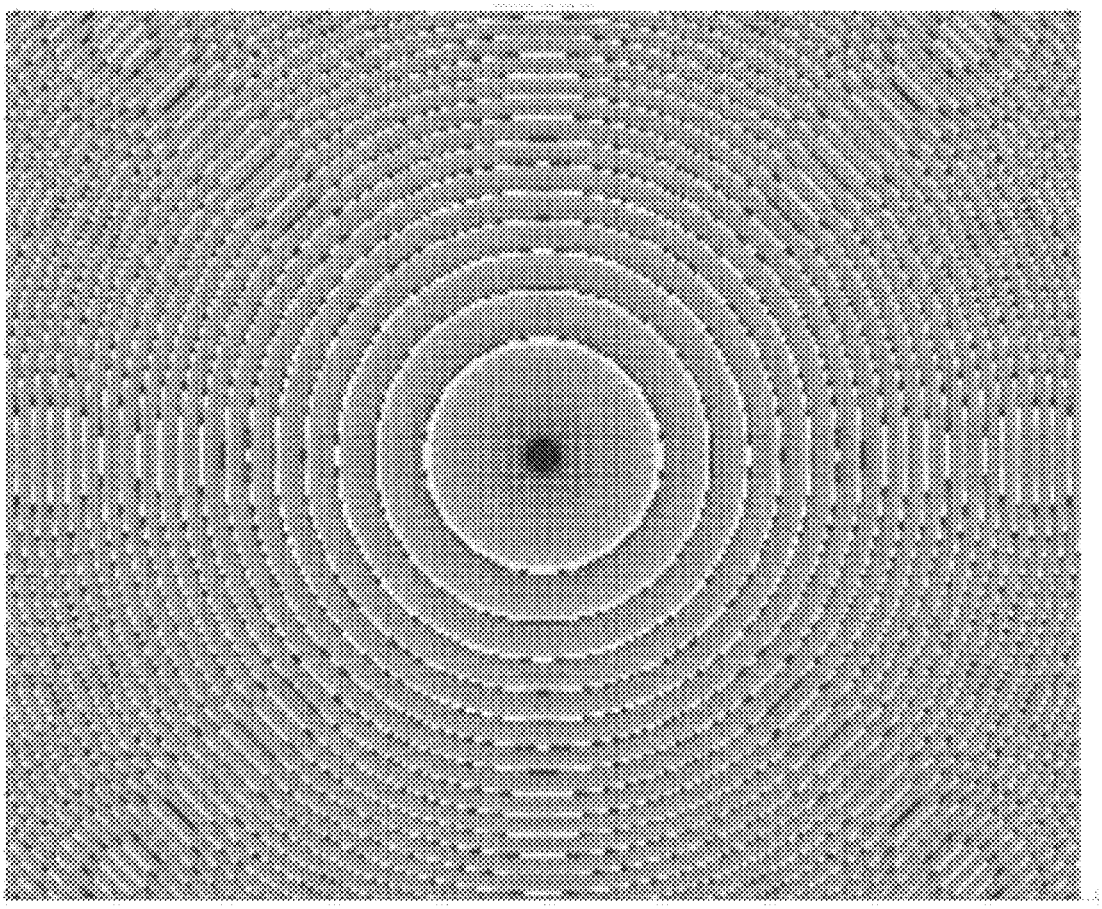
FIG. 4. illustrates an exemplary reflectarray antenna layout.

FIG. 3 illustrates the radiation pattern of one embodiment of the optimized multiflare horn feed (with telescoping waveguides) providing a −10 dB taper at 0=16° at 35.75 GHz using TICRA Champ (Mode Matching & BoR-MoM) and CST MWS. FIG. 3 illustrates data for the E-plane (305) and the H-plane (310). FIG. 4. illustrates an exemplary reflectarray antenna layout.

TABLE 1

| | |
|---|---|
| Frequency | 35.75 GHz |
| Number of elements | 255 × 212 |
| Reflectarray dimensions | 818.32 × 984.3 $mm^2$ |
| Substrate thickness | 0.406 mm |
| Relative permittivity ($\varepsilon_r$) | 3.55 |
| Loss tangent (tanδ) | 0.0027 |
| Focal distance (F) | 0.7 m |

The present disclosure describes a reflectarray having a total surface area compatible with a 6U cubesat space system. In some embodiments, the reflectarray antenna comprises stacking panels on five sides of the spacecraft bus and employs a telescoping feed. The feed can extend away and deploy from the center of the bus. A related exemplary feed is described for the KapDA parabolic mesh antenna system in Refs. [4]-[5]. The stowed feed and system of panels can occupy about 2U of volume within the spacecraft bus, allowing 4U of volume for bus systems and instruments.

The reflectarray antenna can be designed to operate at 35.75 GHz and to minimize (1) spillover and taper loss; (2) loss at the subreflector, feed, and struts; and (3) subreflector diffraction effects. The reflectarray layout can also be designed to account for a varying angle of incidence. The angle of incidence, for example, can vary from the center to the edge of the reflectarray by up to 45°. The focal distance of the reflectarray can be 0.7 m. A center-fed Cassegrain design is chosen, in some embodiments, in order to limit the range of feed deployment needed.

In some embodiments, the Cassegrain reflectarray consists of (1) 15 reflectarray panels; (2) a feed horn; (3) three telescoping waveguides; (4) a rectangular-to-circular waveguide, (5) three struts; and (5) a subreflector. For example, in FIG. 2, the reflectarray comprises 15 panels folded on the side (245), to be deployed during operation. The reflectarray further comprises a feed horn (210), telescoping waveguides (235), a rectangular-to-circular waveguide (240), supporting struts (215) and a subreflector (220).

In some embodiments, the design is chosen such that the subreflector deploys at a distance of 0.62 m, and the feed deploys at a distance of 0.48 m. As visible in FIG. 2 (205), the feed and subreflector fits inside of the cubesat bus when stowed. The capability of being stowed within the spacecraft constrains the design of the feed, subreflector, and telescoping waveguide. In some embodiments, the length of the feed is less than 17 cm; the distance between the tip of the horn and the top of the subreflector is less than 17 cm; and each of the three telescoping waveguide sections is less than 17 cm. With this arrangement, all these elements, when stowed, can fit inside the length of the 6U CubeSat.

In some embodiments, the reflectarray consists of 15 panels (14 deployable and 1 fixed). Of these 15 panels, 6 panels (having a size of 32 cm×17.5 cm) can fold on each side of the CubeSat spacecraft (i.e. a total of 12 panels), and 2 panels can fold on the central side of the CubeSat bus (having a size of 32 cm×12.1 cm). The telescoping waveguide deploys from this central side (as visible in FIG. 2). When deployed, the reflectarray, in this embodiment, measures 81.8 cm×98.4 cm.

In some embodiments, three telescoping circular waveguides are used to deploy the feed and subreflector, as visible in FIG. 2. One waveguide remains fixed to the CubeSat as the two others deploy with the feed and the subreflector. The deployment of the horn and telescoping waveguides can be ensured using a coilable boom. A compression spring extends the subreflector along the horn. The alignment of the feed horn and the first telescoping waveguide can be made accurate to +/−0.1 mm to avoid generating a TM11 mode. The TM11 mode would affect the radiation pattern of the feed, and therefore alter the antenna pattern. A deployment accuracy of +/−1 mm can be required on the two lowest waveguide sections.

A short rectangular-to-circular waveguide can be used at the bottom of the fixed telescoping waveguide to provide linear polarization. In some embodiments, the subreflector is a rectangular hyperboloid with a vertex distance of 9.5 cm and a foci distance of 27 cm. In these embodiments, the subreflector rectangular rim dimension is 12.4 cm×9.9 cm. In some embodiments, one of the dimensions of the subreflector is limited to 9.9 cm in order to fit inside the CubeSat bus. The subreflector alignment, with respect to the feed, can be maintained using three struts, as in Ref. [4]. This type of deployment was previously demonstrated at 35.75 GHz, showing that the required vertical deployment accuracy can be maintained. No significant tilting was observed in practice. Table 2 lists measured and calculated gain and efficiency for an exemplary reflectarray.

In some embodiments, the feed was optimized to provide a −10 dB taper at 16° using TICRA Champ, BoR-MoM. In these embodiments, the phase center of the feed is placed at one of the two focal points of the subreflector. In some embodiments, the feed consists of a multiflare horn antenna (as visible in FIG. 2) as it has advantages over corrugated or smooth-walled horns (see Ref. [8]), such as the ease of fabrication and low cost. is fairly easy to fabricate and low cost compared to corrugated or smooth-walled horns. In some embodiments, the horn design was validated using CST MWS. FIG. 3 illustrates excellent agreement between TICRA Champ and CST MWS. In (310) the two lines (continuous and dashed) are, for the most part, overlapping.

Figure 5:
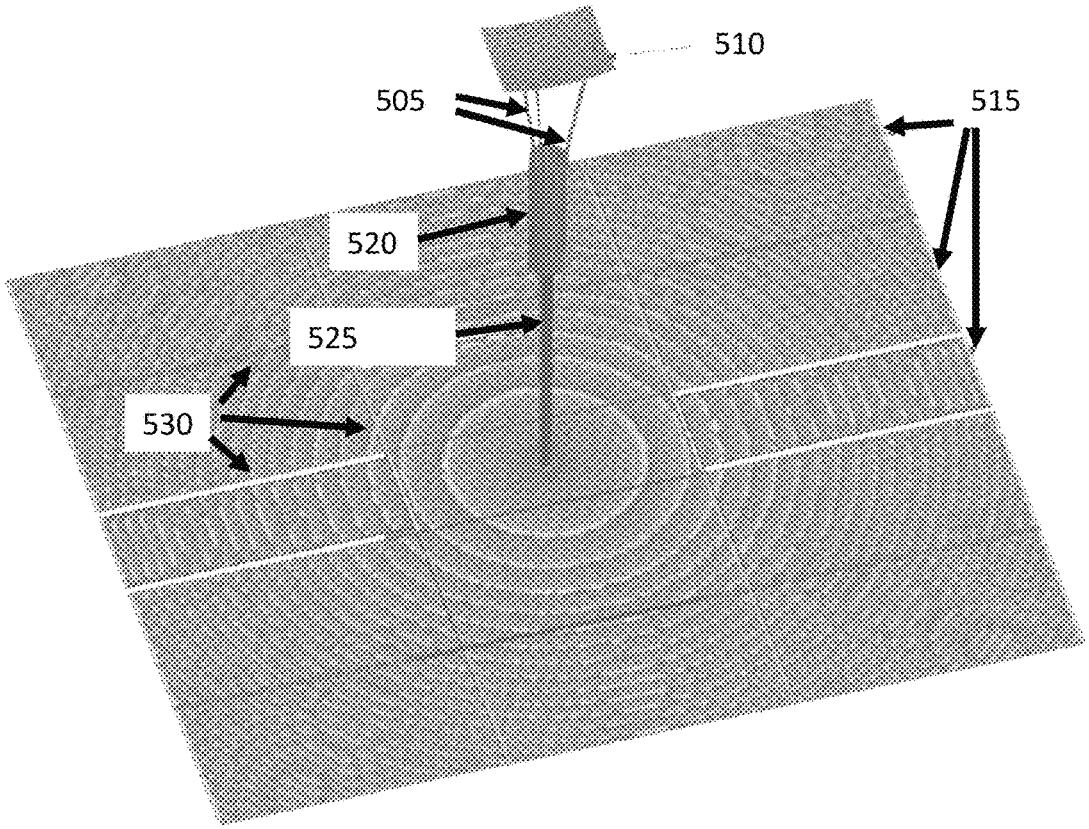
FIG. 5 illustrates a 3D model of an exemplary lm-deployable reflectarray antenna with 15 panels.
Figure 6:
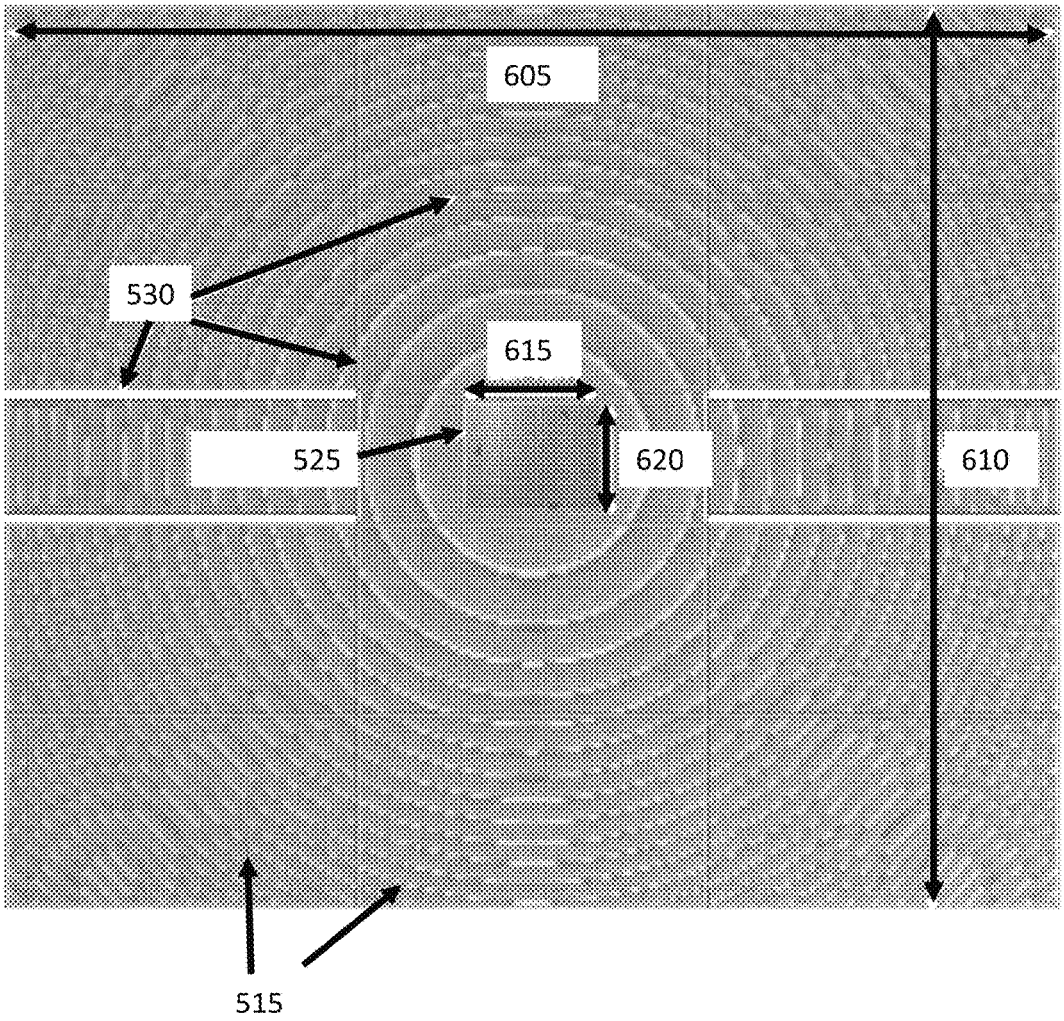
FIG. 6 illustrates a top view of the 15 panel reflectarray of FIG. 5.

In some embodiments, a reflectarray with 255×212 elements and a focal distance of 0.7 m is employed in the present disclosure. An exemplary reflectarray layout is illustrated in FIG. 5. FIG. 5 illustrates a 3D model of the 1 m-deployable reflectarray antenna with 15 panels. FIG. 6 illustrates a top view of the 15 panel reflectarray of FIG. 5. In the example of FIG. 5, the central panel, from which the horn extends, can be attached to the spacecraft and therefore does not require deployment. The remaining 15 panels surrounding the central panel are folded along the sides of the spacecraft and are deployed prior to operation.

TABLE 2

| | Gain (dBi) | Loss (dB) |
|---|---|---|
| Ideal directivity | 51.58 | — |
| Spillover | 50.67 | 0.91 |
| Taper | 49.95 | 0.72 |
| Blockage | 49.67 | 0.28 |
| Struts (x3) | 49.37 | 0.3 |
| Gap loss | 48.87 | 0.5 |
| Patch dielectric/cond loss | 48.62 | 0.25 |
| Surface rms (+/−0.15 mm) | 48.52 | 0.2 |
| Feed loss | 48.12 | 0.3 |
| Feed mismatch (RL = 17 dB) | 48.03 | 0.09 |
| Total | 48.03 | 3.55 |

In some embodiments, the minimum F/D can be 0.71, and therefore it can be important to account for the angular sensitivity of the phase response of the element. Indeed, in some embodiments, the maximum angle of incidence at the edge of the antenna can be $\theta_{max}$=45°. Noticeable deviation from normal incidence can be observed at the angle of incidence $\theta_0$=20°. Hence, a database was built including both the size of the patch and the angle of incidence. The exemplary reflectarray layout was then generated as shown in FIG. 4.

As visible in FIG. 5, in some embodiments the reflectarray comprises three struts (505), a subreflector (510), foldable panels (515), a horn (520), and telescoping waveguides (525). Gaps between panels are also illustrated (530). FIG. 6 illustrates the same elements in a top view. In some embodiments, the lateral dimensions of the reflectarray can be 98.4 cm (605) and 81.8 cm (610), as illustrated in FIG. 6 by arrows. In some embodiments, the lateral dimensions of the subreflector can be 12.4 cm (615) and 9.9 cm (620), as illustrated in FIG. 6 by arrows. Some exemplary design parameters of the reflectarray are summarized in Table 2. The overall antenna performance can be calculated using a reflectarray code based on physical optics (PO). The feed horn, combined with the three struts, the sub reflector, and telescoping waveguides, can be modeled as a MoM/MLFMM object. As known to the person of ordinary skill in the art, MoM stands for Method of Moment, and MLFMM stands for multilevel fast multipole method. A waveguide port can be employed to excite the MoM/MLFMM object. The horn itself can be defined using two piecewise linear body of revolution objects, one for the interior and one for the exterior. These two objects can be combined in a scatterer cluster and will define the horn geometry. A scatterer cluster including the three struts, the subreflector, and telescoping waveguides, is created and used as a MoM/MLFMM object. The current is calculated at the reflectarray surface.

Figure 7:
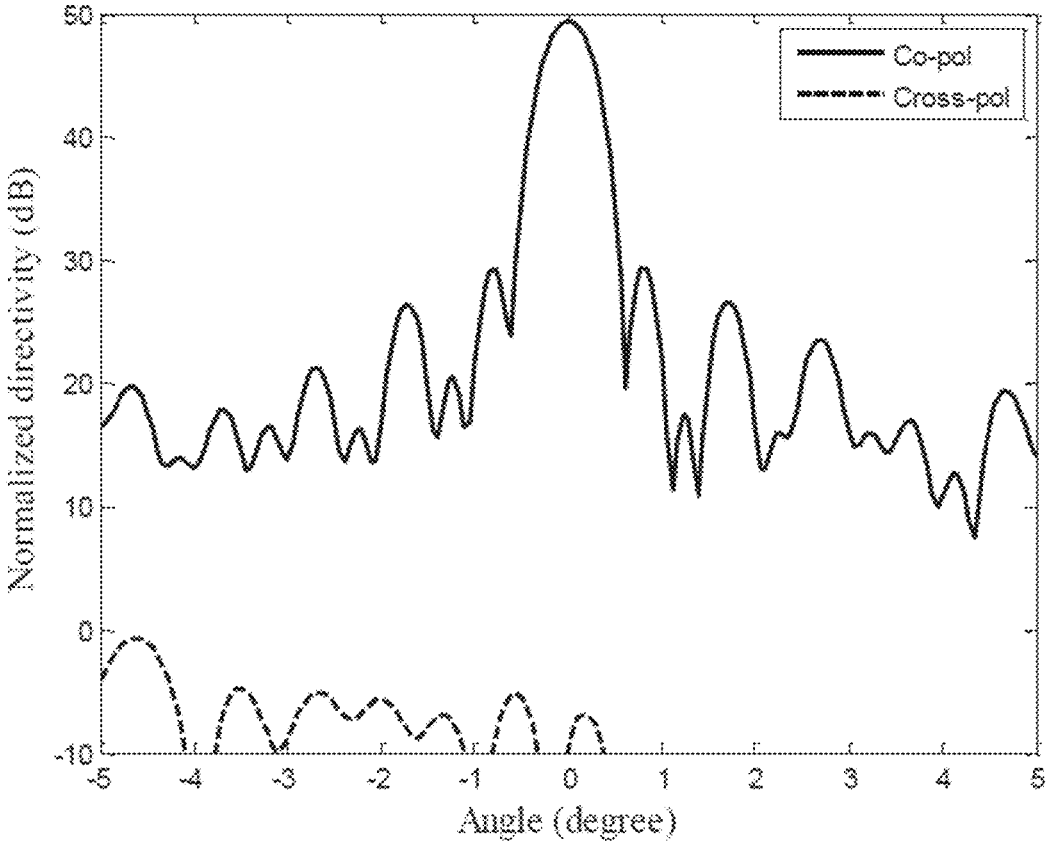
FIGS. 7-9 illustrate radiation patterns calculated at 35.75 GHz.
Figure 8:
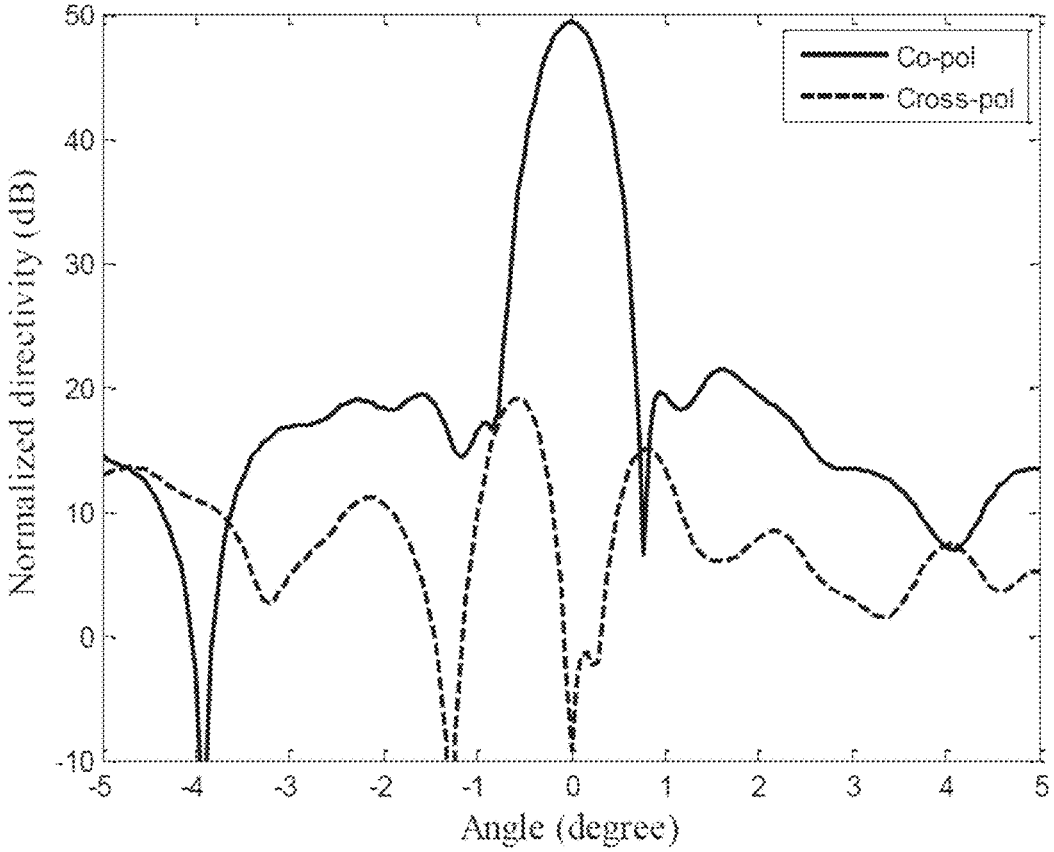
Figure 9:
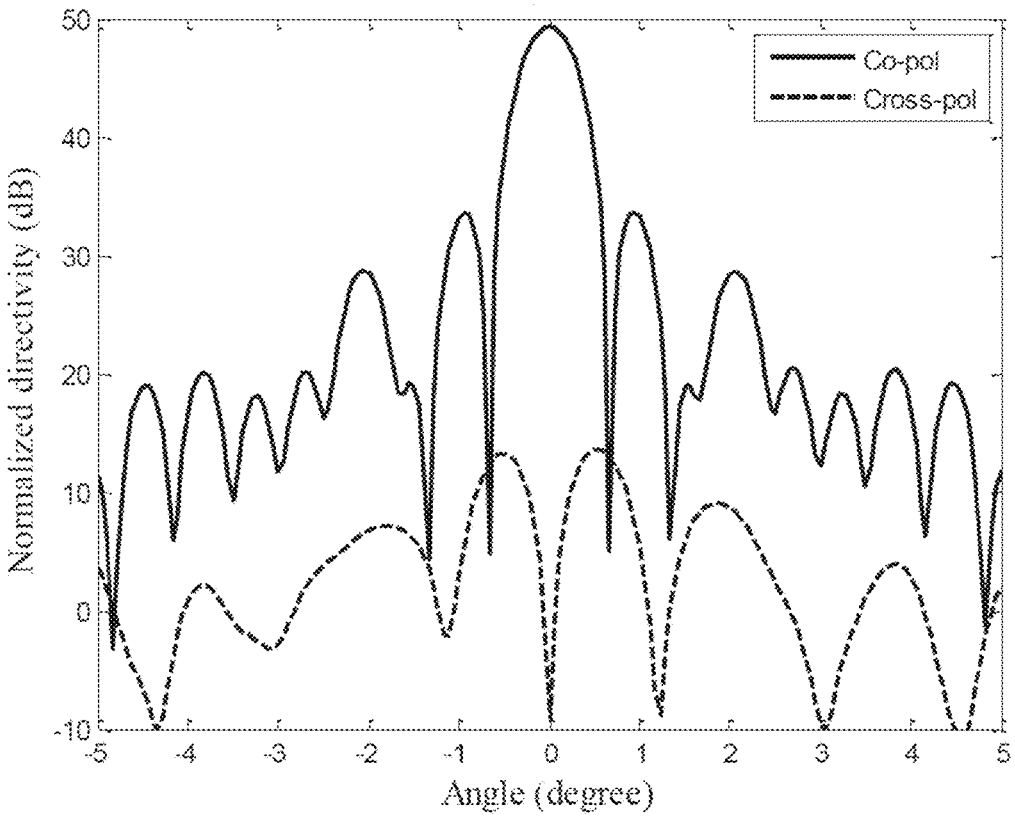

In some embodiments, the optimized gain is estimated to be 48.0 dBi at 35.75 GHz. This value translates into an aperture efficiency of 44% at 35.75 GHz. The various contributors to the overall efficiency factor for this embodiment are estimated and listed in Table 2. The radiation patterns calculated at 35.75 GHz are shown in FIGS. 7-9. FIG. 7 illustrates the calculated antenna radiation pattern at 35.75 GHz in the E-plane. FIG. 8 illustrates the calculated antenna radiation pattern at 35.75 GHz in the D-plane. FIG. 9 illustrates the calculated antenna radiation pattern at 35.75 GHz in the H-plane.

As described above, an exemplary 1-m deployable Cassegrain reflectarray antenna is developed at Ka-band for an Earth Science radar. In some embodiments, the reflectarray offers a gain of 48.1 dBi and an efficiency of 45%, while fitting in a constraining volume compatible of 6U CubeSats. In some embodiments, the gain can be greater than 47.5 dBi, with $S_{11}<-14$ dB, where $S_{11}$ is an antenna S-parameter as known to the person of ordinary skill in the art.

Figure 10:
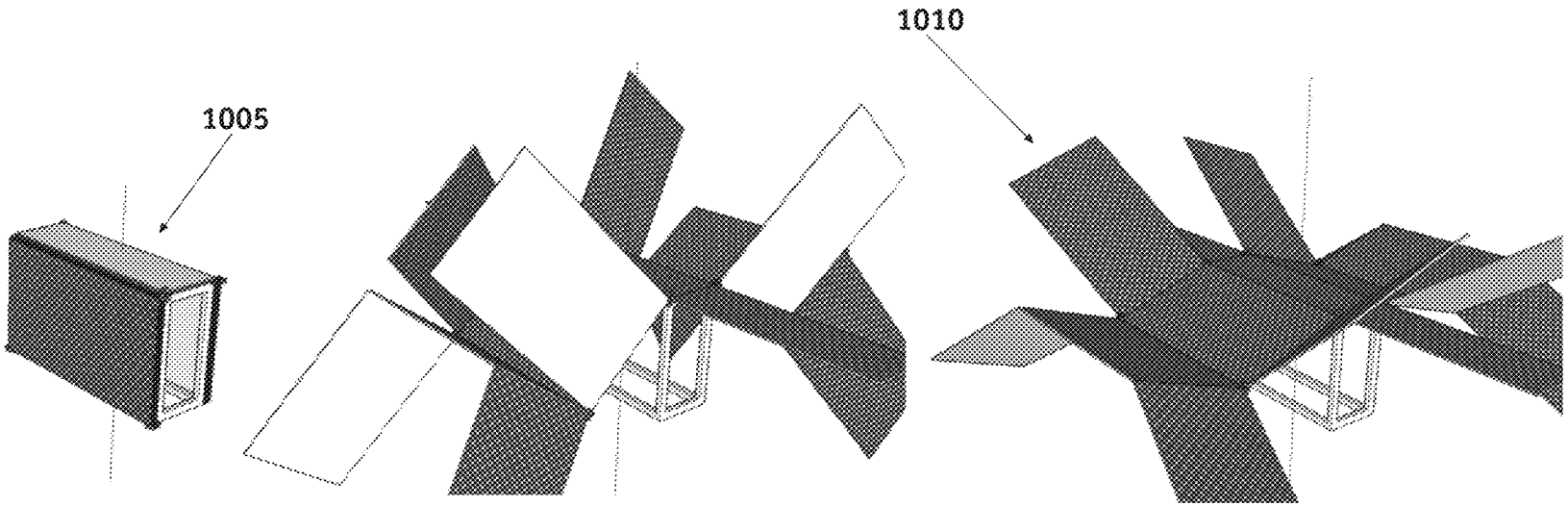
FIG. 10 illustrates an exemplary deployment sequence for the reflectarray panels.

FIG. 10 illustrates an exemplary deployment sequence for the reflectarray panels. In this embodiment, the central panel (1005) will remain stationary, while the remaining panels (1010) will unfold from the sides of the spacecraft to the deployed position. In this example, 14 panels are deployed to form the reflectarray together with the central panel. From the central panel the horn and subreflector can be deployed. In the simplified view of FIG. 10 these additional elements are not visible. In FIG. 10, the view of some of the panels is cut off, as can be understood by the person of ordinary skill in the art.

As described above, the system of the present disclosure comprises a feed, a secondary reflector assembly, horn, waveguide, and deployment driving mechanisms. The system may also comprise one or more of deployable guide plates, which help to guide the deployment mechanisms.

The secondary reflector assembly can comprise a sub-reflector attached by struts to a collar, which encircles the horn, for example as visible (206) in FIG. 2. This configuration allows the sub-reflector to telescope along the horn. The secondary reflector can also include features for locating cables, which precisely place the sub-reflector and horn and mating features for the deployment driving mechanisms.

The horn is primarily an RF component, which connects to the secondary reflector assembly at the top, and the waveguide at the bottom. The horn can have a locate slot in it to keep the sub-reflector assembly aligned as it telescopes along the horn.

In some embodiments, the waveguide consists of three precision tubes, each telescoping within each other, and has features as in the following. The waveguide is attached to the horn via a threaded insert in the horn. This allows the waveguide to be removed from the horn. At the opposite end of the waveguide is a flange, bonded to the waveguide. To ensure a good bond and precise fit, the flange has a hole the exact diameter of the waveguide, with slots for a bonding material to fill. The waveguide connects to the base guide plate. The deployable tapes go through this base guide plate which sets their initial position.

In some embodiments, the deployable mechanism consists of two motorized tape deployers, which deploy a tape spring wound about a spool. In some embodiments, the deployable guide plate guides the tapes near the top of the CubeSat, which increases overall stiffness. The horn can also comprise a guide feature.

The present disclosure describes several advantageous features, as described in the following. Tape springs rolled up on a spool can be used to deploy the feed. A multi-stage telescoping waveguide facilitates deployment. A compression spring within the walls of the waveguide can be used to precisely locate the waveguides position. The design of the system that precisely locates the secondary reflector assembly, and allows location of the secondary reflector assembly to position the location of the feed. The secondary reflector can be located by a cable hexapod. The removable telescoping waveguide can be detached from the horn via a threaded flange.

In some embodiments, the struts in the sub-reflector have a design to ensure the panels can fit on either side of the S/C (this enables a compact 6U design). The deployable guide plate for an antenna feed deployment helps to increase stiffness. The feed with guide features also helps to increase stiffness.

Figure 11:
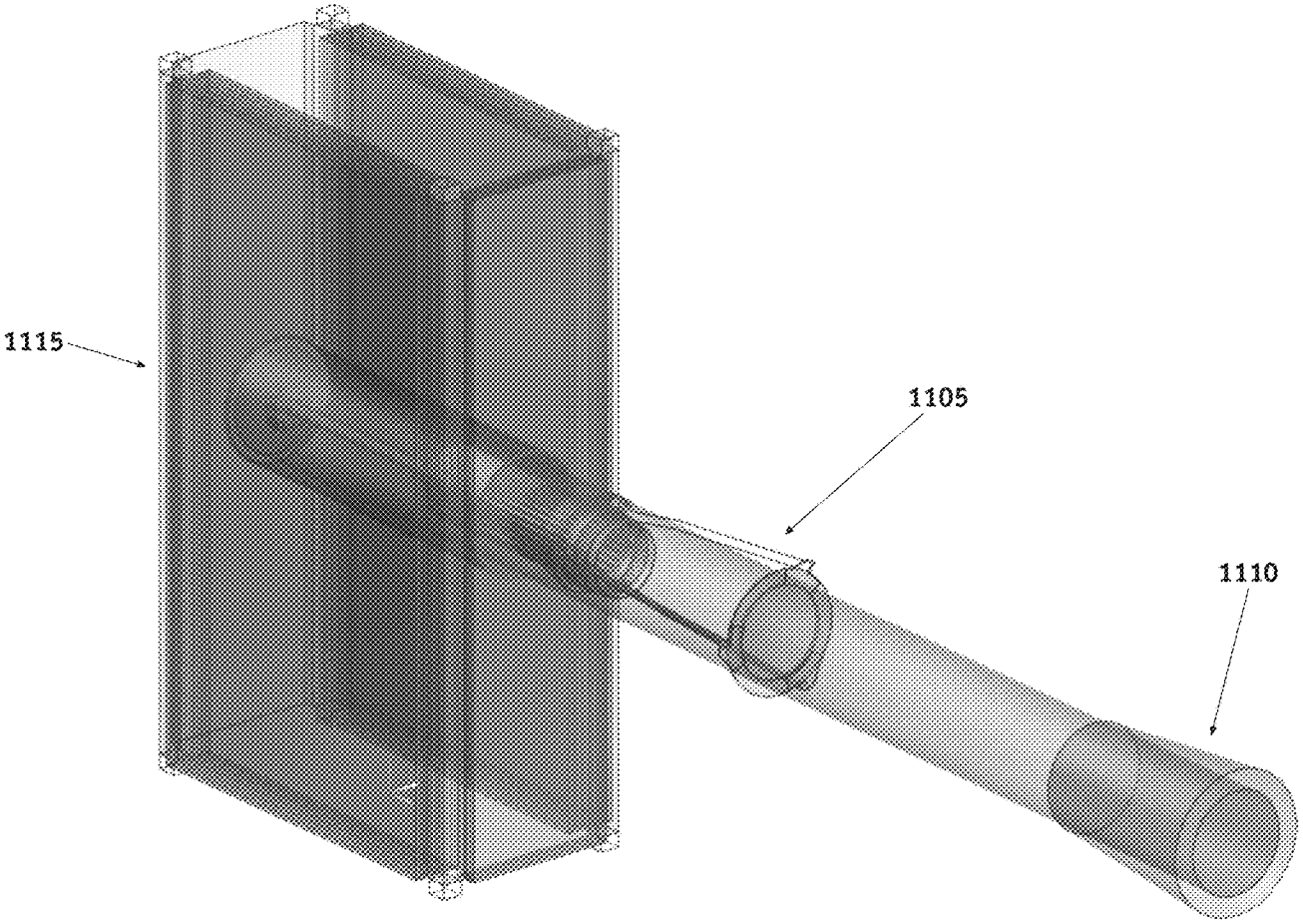
FIG. 11 illustrates an exemplary horn and feed assembly progressively telescoping.
Figure 12:
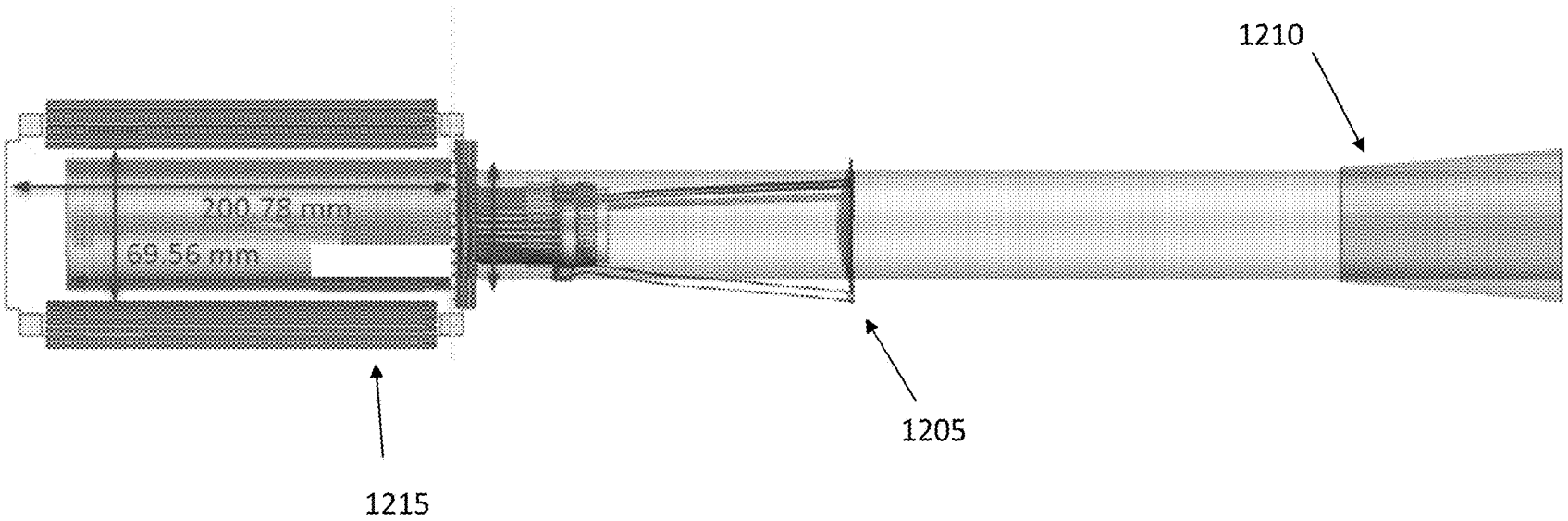
FIG. 12 illustrates an exemplary side view of the telescoping feed.

FIG. 11 illustrates an exemplary horn and feed assembly progressively telescoping out of the spacecraft body (1115), during deployment, from an intermediate position (1105) to the final position (1110). FIG. 12 illustrates an exemplary side view of the telescoping feed, in an intermediate (1205) and final (1210) position. The panels are stowed on the sides (1215) of the spacecraft body.

In the following, other exemplary embodiments of the deployable reflectarray antenna will be described. In the following, values of parameters and description of features should be understood as examples, and not limiting the scope of other embodiments. In some embodiments, the present disclosure describes the design and optimization of a large deployable reflectarray compatible with the 6U-class CubeSat. The deployable reflectarray is designed to fulfill the requirements of a constellation of precipitation radar which operates at 35.75 GHz with linear polarization. Calculations and measurements show that 47.8-dBi gain and 42% aperture efficiency are obtained at 35.75 GHz.

With the recent advances in miniaturized RADAR and CubeSat technologies, launching multiple copies of a RADAR instrument is now possible.

Small spacecraft offer large opportunities for a range of Earth scientific observation, telecommunications, remote sensing, imaging and other applications. The small volume and mass of the space systems allows frequent and low-cost access to space through ride-along launches with other larger manifested spacecraft, as well as single purpose launches where the cost is distributed among many small spacecraft. Smaller, single purpose launch systems being developed may propel the field even more. The application of commercial space electronics and standardized spacecraft bus subsystems has also successfully motivated the field. Small spacecraft for deep space and planetary exploration are similarly being developed, though the cadence is much less than Earth orbiting systems due to limited deep space launch opportunities.

An outstanding need associated with small spacecraft is an RF or optical aperture that is commensurate with the scale of the overall space system. For Earth observing systems, solid optical apertures that fit into small satellites without deployment are in regular use, meeting a range of requirements. Additional research continues for larger deployed optical apertures. RF apertures that will produce high gain for telecommunications applications, or are needed to produce narrow beamwidths for Earth science needs, are currently under development. For apertures that will be larger than the bus dimensions and hence need to be deployed, driving parameters comprise both the deployed precision for the frequency of operation, as well as stowed volume during launch. There is an additional system efficiency that can be considered, since increasing the aperture too much can result in pointing, thermal, and other issues that can make the small spacecraft impractical from cost and spacecraft system accommodation standpoints.

As described in the present disclosure, one approach for an RF deployed aperture is a reflectarray antenna where the panels are held against the side of the spacecraft bus during launch, and deployed in a hinged system on-orbit. The flat, two-dimensional reflectarray antenna geometry obviates the additional volume needed for traditional aperture antennas which are deployed with a parabolic surface, or other conic three-dimensional surfaces. The reflectarray panels can be fabricated to meet on-orbit thermal demands and launch dynamic requirements, providing the necessary deployed precision when coupled with appropriate hinges connecting the panels. A release mechanism allows the panels to deploy on orbit. A first application of this approach integrated solar panels with the reflectarray antenna (ISARA) operating at Ka-band, combining the two functions and resulting in small additional mass and volume increase over the solar panels themselves. This approach was extended to an X-band telecommunication system using a reflectarray deployed from a 6U CubeSat, to be jointly launched with the NASA InSIGHT Mars lander mission, to provide auxiliary telecommunications during the entry descent and landing portion of that mission.

The present disclosure extends the size of the reflectarray to what is considered practical for a 6U CubeSat space system, stacking panels on five sides of the spacecraft bus and employing a telescoping feed from the center of the bus. This feed follows and extends work in the KapDA parabolic mesh antenna system to feed the reflectarray. The stowed feed and system of panels removes about 2U of volume within the spacecraft bus, allowing 4U of volume for bus systems and instruments.

In order to achieve a wider bandwidth and higher efficiency, a large f/D ratio is generally needed for a reflectarray. A large f/D implies that the focal feed has to protrude far from the array aperture, which can result in a complex deployment and larger mass. The Cassegrain configuration, shown for example in FIG. 1, can reduce the feed and subreflector height while maintaining the same or a higher effective f/D ratio.

In addition, the transmission loss between the feed and the transceiver can be significantly reduced, which is especially important at higher frequencies, such as Ka-band. The subreflector can, in some embodiments, be replaced by a reflectarray. Using a flat subreflector, such as a flat reflectarray, can reduce the overall mass of the antenna.

To mitigate these losses, coaxial cables are not an efficient option. Hence, the present disclosure describes the use of three telescoping waveguides to maximize the antenna efficiency. Using a three stage waveguide design can be advantageous compared to a single stage telescoping waveguide. In a single stage telescoping waveguide, the horn telescopes around the waveguide, and no portion of the waveguide moves. In the present disclosure, both the horn and two sections of the telescoping waveguide move. Table 3 lists exemplary dimensions for the three waveguide components. In the present disclosure, waveguide components are moving relative to each other, while in the single stage approach the horn moves relative to the waveguide, but the waveguides are fixed. The telescoping waveguides can be either circular or rectangular, depending on the polarization of the antenna. For telecommunications, the polarization can be circular as right hand circular polarization is generally required. For radar applications, rectangular waveguides can be used.

In some embodiments, the reflectarray antenna operates at 35.75 GHz, and the overall dimensions can be 922.5×1049.2 $mm^2$, consisting of 322×366 elements. The focal distance can be equal to 0.7 m. The subreflector vertex and foci distance can be equal to 0.095 m and 0.22 m, respectively. The subreflector dimensions can be selected to maximize the antenna efficiency while fitting inside the CubeSat stowage volume. The subreflector rim dimensions can be 99.0×124.0 $mm^2$. In some embodiments, the maximum possible directivity $D_{max}=(\pi \cdot D/\lambda)^2$ of the reflectarray is 45.45 dBi at 35.75 GHz.

TABLE 3

| Waveguide number | Inner dimension (mm) | Outer dimension (mm) |
|---|---|---|
| 1 | 9.35 | 10.15 |
| 2 | 7.85 | 8.65 |
| 3 | 6.35 | 7.15 |

Figure 13:
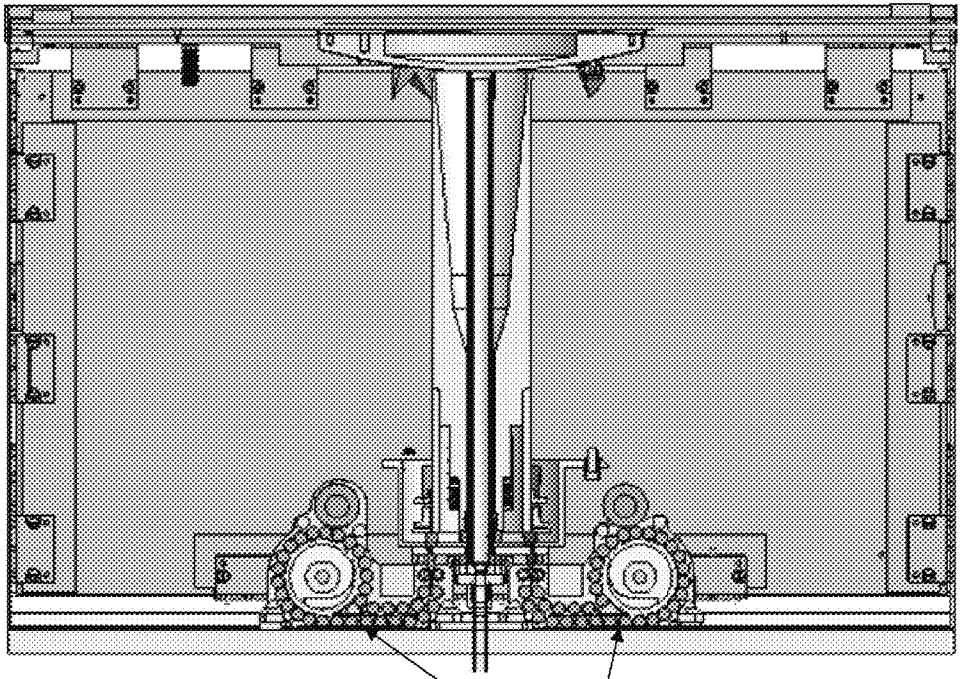
FIGS. 13-15 illustrate different stages of deployment for the feed and waveguides.
Figure 14:
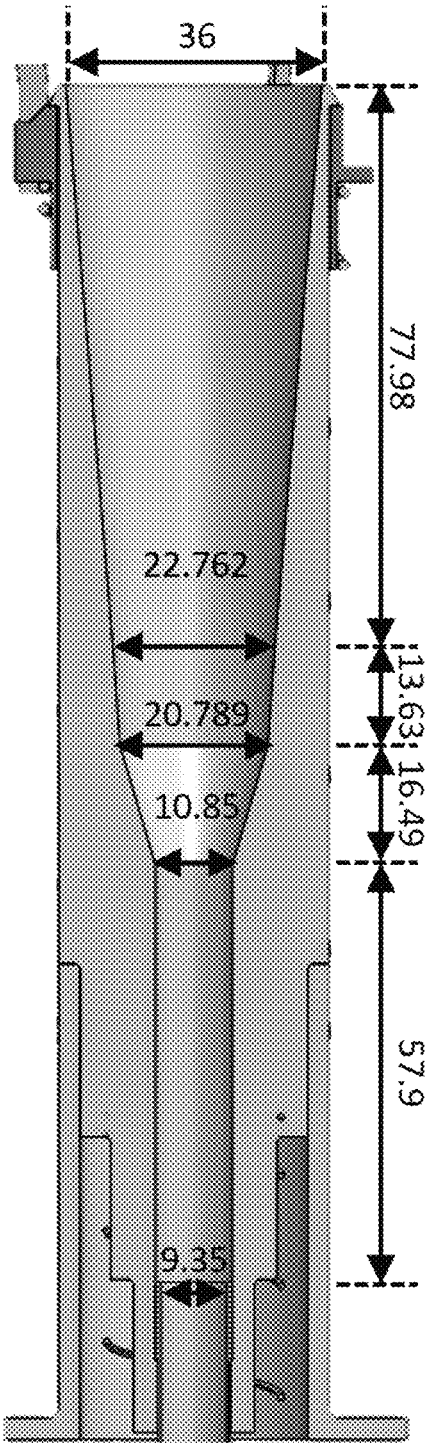
Figure 15:
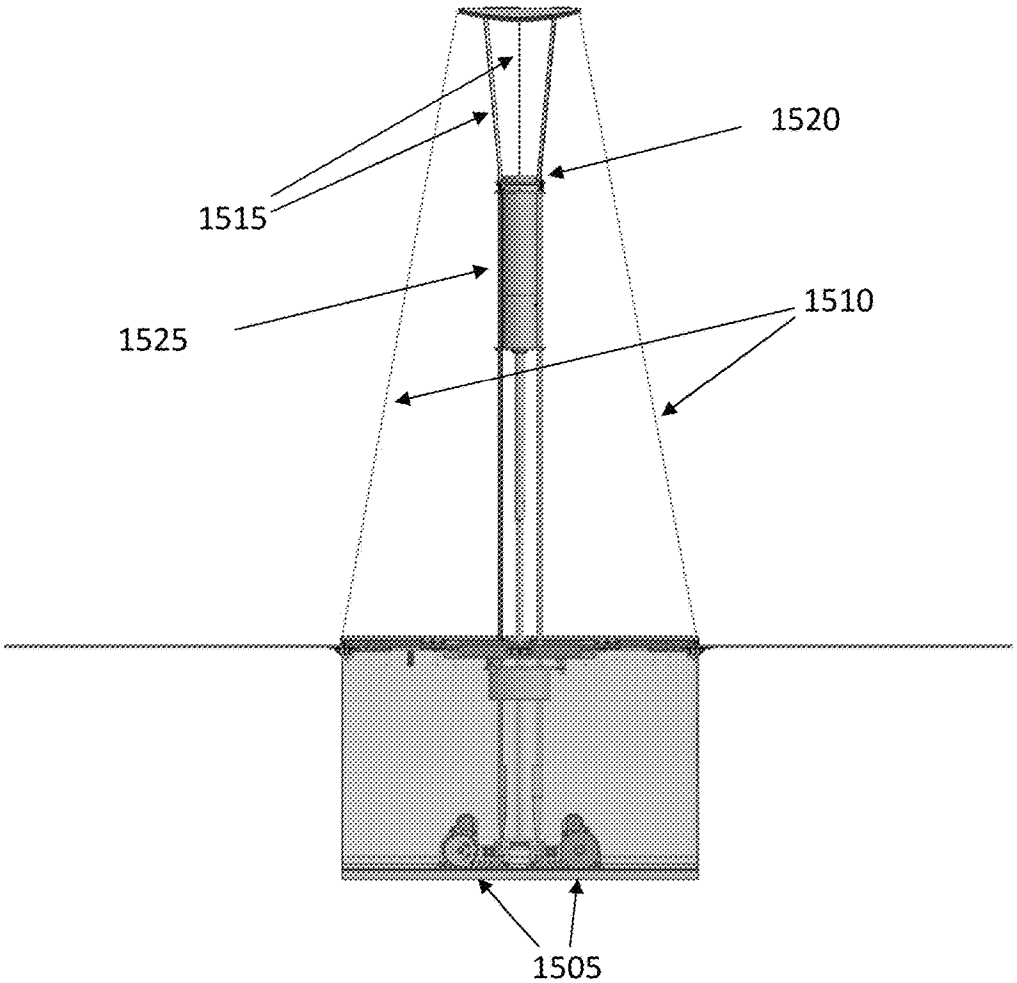

The telescoping feed comprises a multiflare-angle horn and three telescoping waveguides with increasing inner diameter. FIGS. 13-15 illustrate different stages of deployment for the feed and waveguides. When stowed, the telescoping waveguides fit inside the horn, as illustrated in FIG. 13. The bottom waveguide, with the smallest diameter, remains fixed in the CubeSat. The two other waveguides, the feed horn, and the subreflector slide upward thanks to two metering tapes. An example of metering tapes is illustrated in FIG. 13, (1305), and FIG. 15, (1505). The metering tapes can be controlled by two synced motorized systems. Quartz cables (1510), for example, four cables, can be employed to further improve the feed deployment accuracy. Cables can be used to precisely position the secondary reflector. For example, a cable hexapod can be used.

Figure 35:
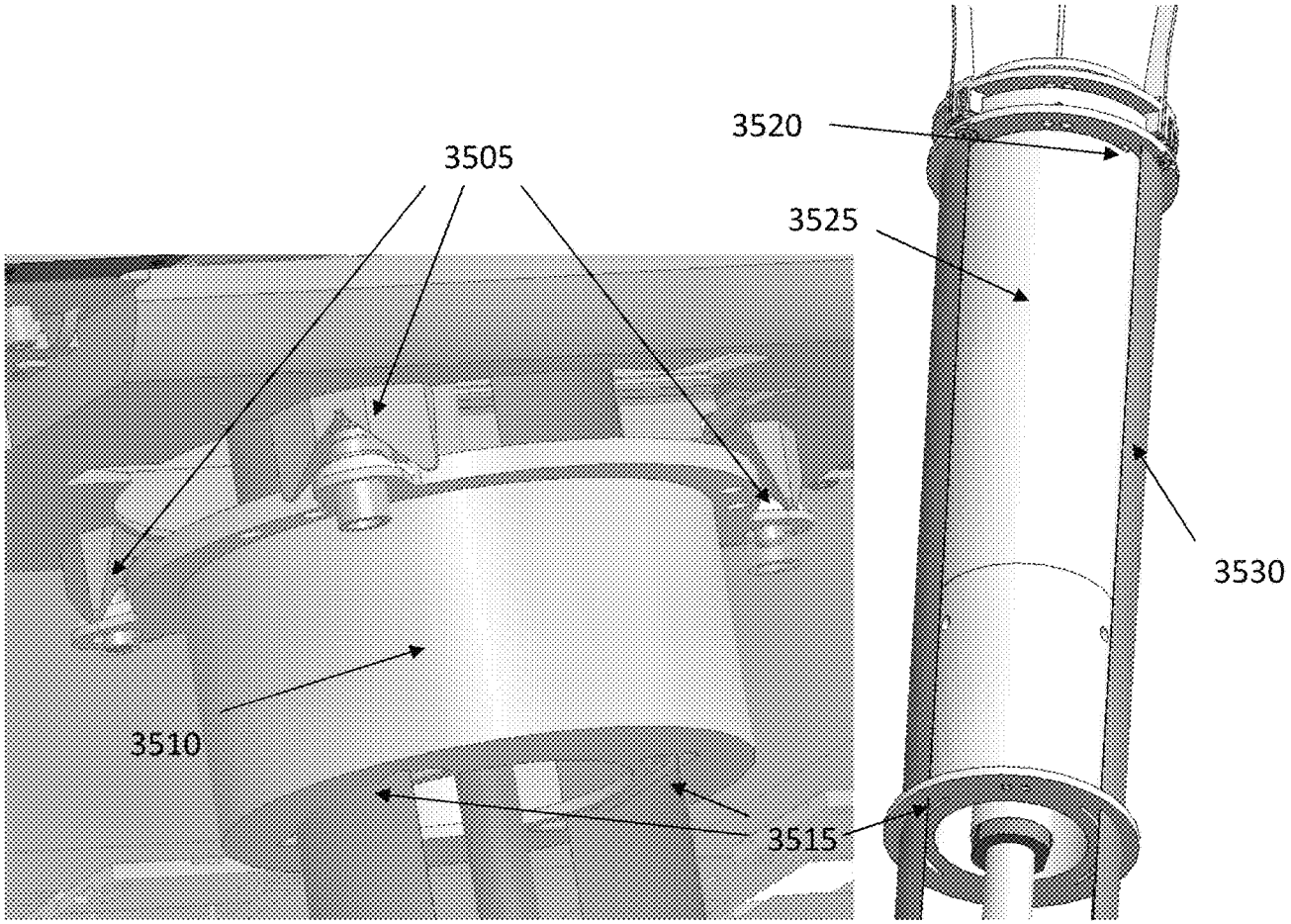

The subreflector can be attached by three struts (1515) to a collar (1520), which encircles the horn (1525). This configuration allows the subreflector to telescope along the horn. The secondary reflector can also include features for positioning cables, which precisely place the sub-reflector and horn, and mating features for the deployment driving mechanisms. Two slots can be included in the horn to keep the sub-reflector assembly aligned as it telescopes along the horn. The subreflector clocking is important to the design as it determines the edge taper of the rectangular main reflector. Clocking of the sub-reflector refers to the rotation of the sub-reflector about the center axis of the horn (i.e. rotating about the longitudinal horn). It is important to prevent the sub-reflector collar from rotating about the horn. This is currently achieved with the deployment tapes, such as (3530) in FIG. 35, which will prevent the sub-reflector collar from rotating. One or more slots on the horn also help in preventing clocking from occurring, to prevent the collar from rotating as the sub reflector deploys. In the embodiment of FIG. 35, two tapes are used. However, in other embodiments, it is possible to achieve better alignment by using four tapes instead of two. In the embodiments with four tapes, the tapes can control the x-axis and y-axis as well. However, using four tapes uses more space. Therefore, in some embodiments, two tapes are used to fit inside a CubeSat. In small satellites that do not adhere to the CubeSat volume, more than two tapes could easily be accommodated. Four tapes would therefore provide a stiffer structure, a very useful feature in a small satellite spacecraft that does not have the same volume constraints of a CubeSat. This would allow the feed to be deployed further out enabling it to support larger antennas.

In some embodiments, the sub-reflector and feed deploy to within 0.1 mm on the z-axis and 0.1 mm on the x- and y-axis of their ideal position. A compression spring can be employed within the walls of the waveguide, to precisely position the waveguides.

Figure 16:
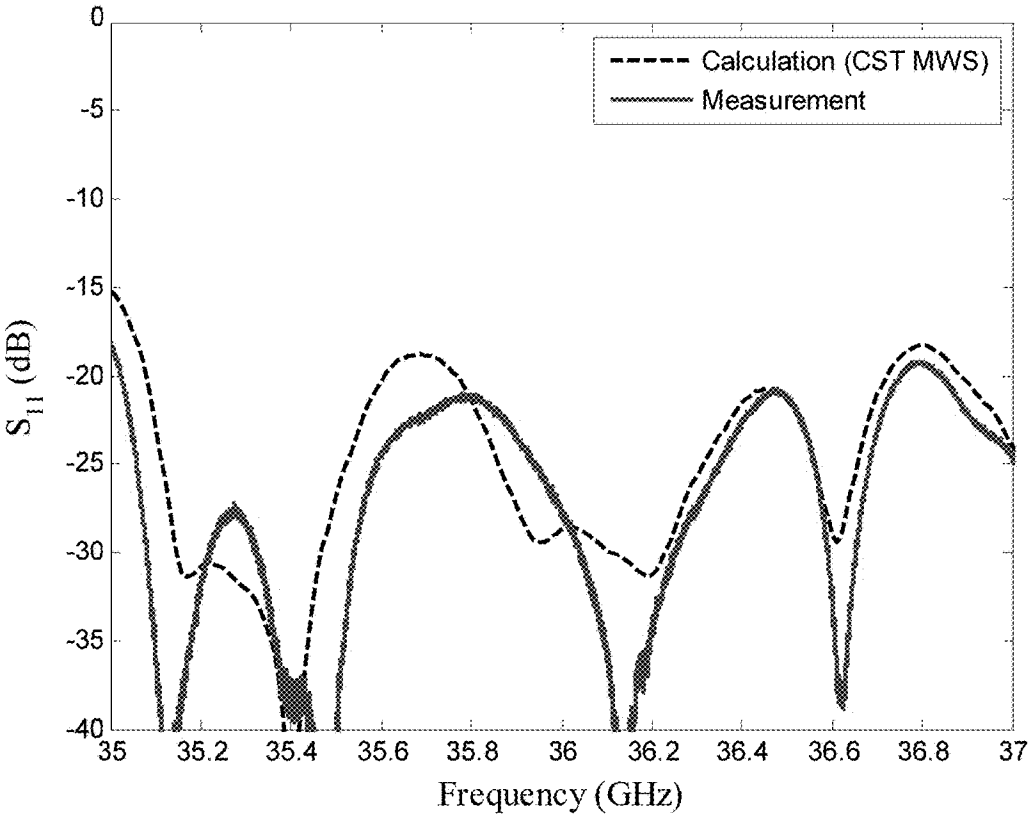
FIG. 16 illustrates calculated and measured reflection coefficients of the feed horn.
Figure 17:
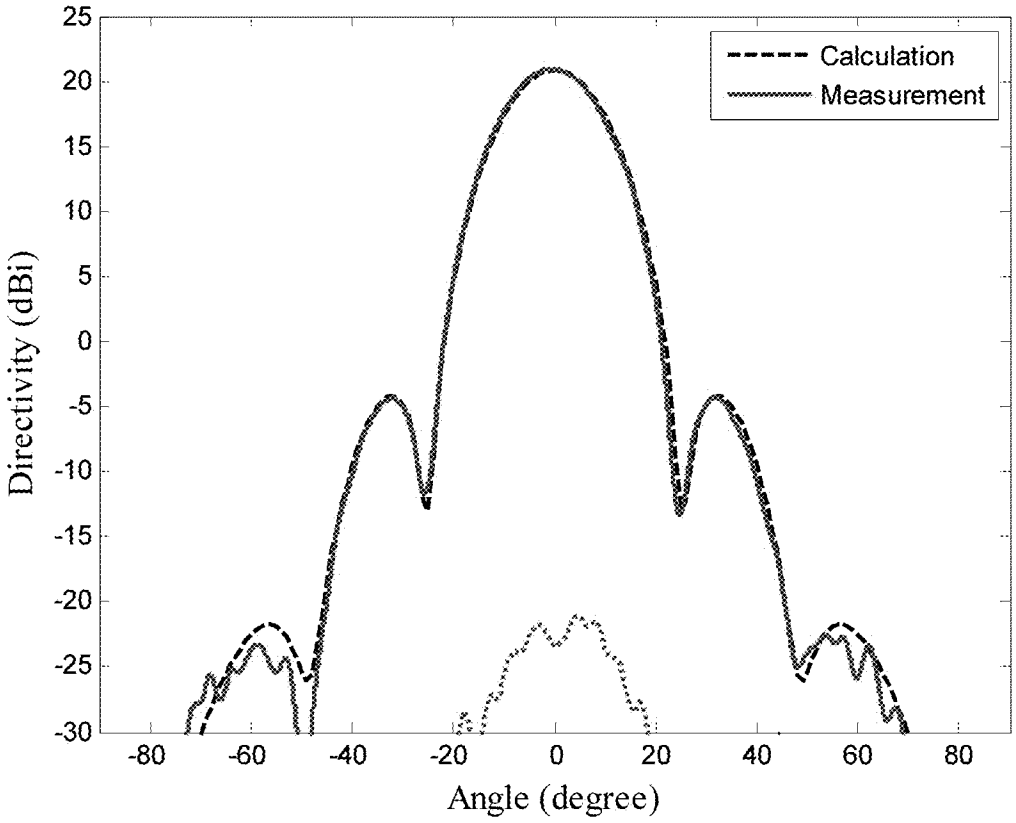
FIGS. 17-18 illustrate the telescoping feed horn radiation pattern at 35.75 GHz.
Figure 18:
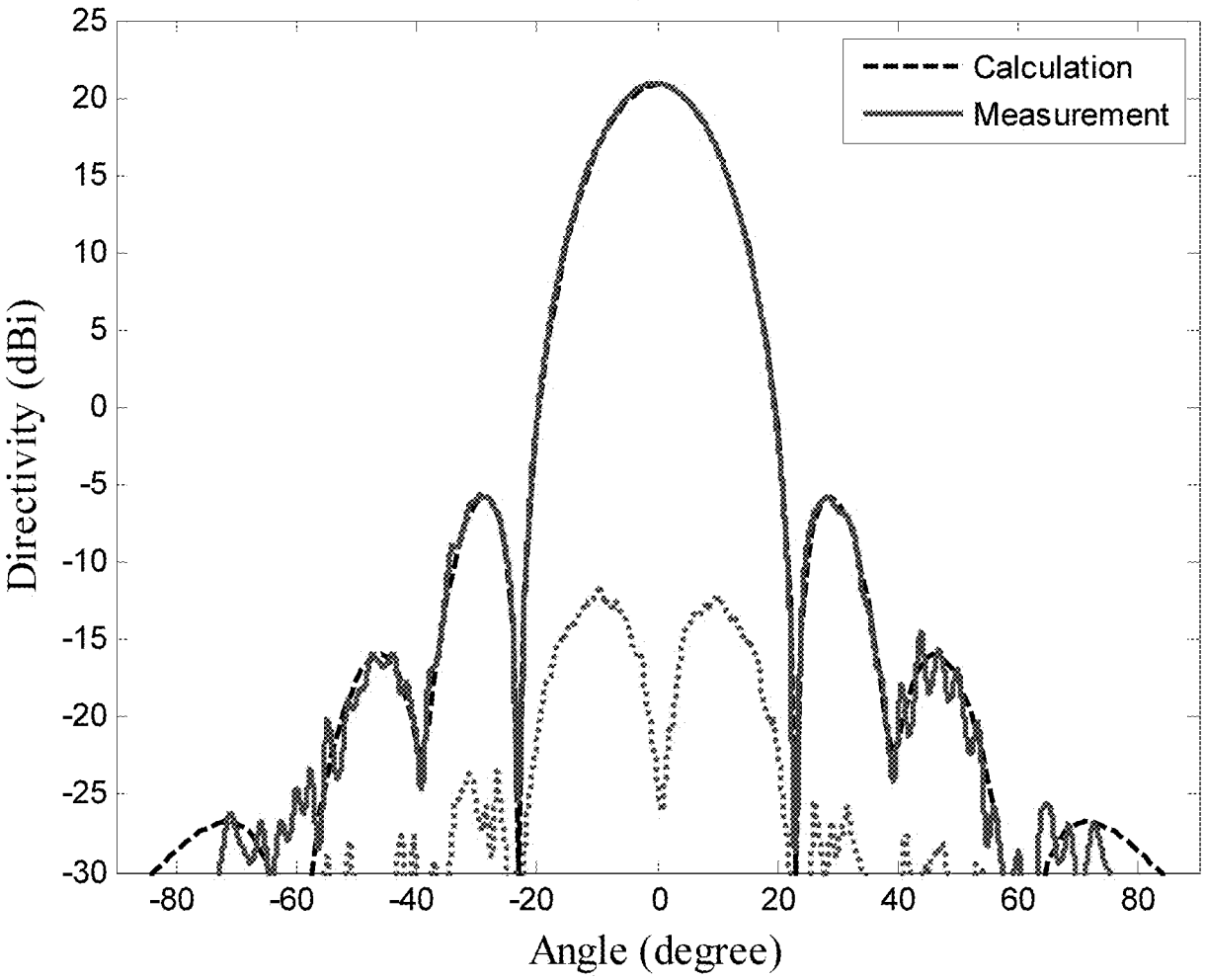
Figure 19:
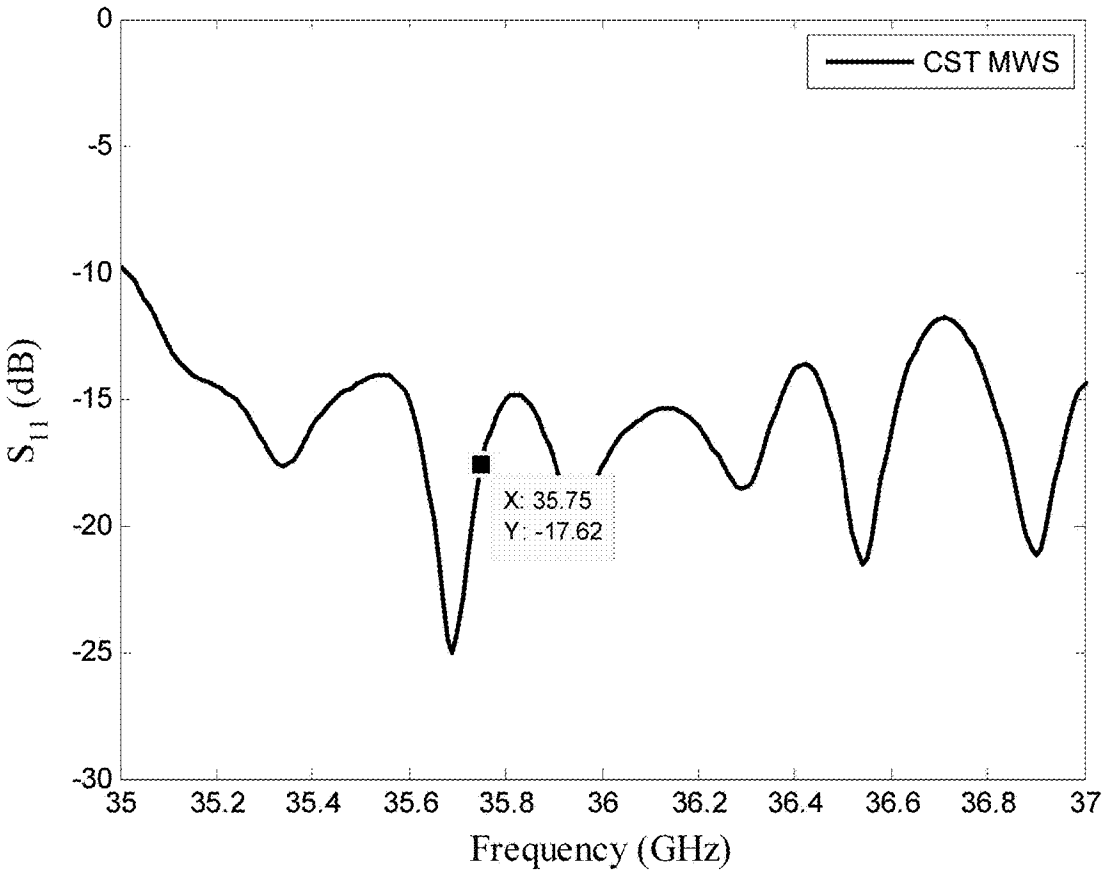
FIG. 19 illustrates calculated and measured reflection coefficients of the feed with its subreflector and three struts after deployment.

FIG. 14 illustrates exemplary dimensions of the feed horn. The calculated and measured reflection coefficients of the feed horn with the three waveguides are plotted in FIG. 16, showing good agreement. The telescoping feed was measured in the cylindrical near-field anechoic chamber of NASA's Jet Propulsion Laboratory. The calculated and measured radiation patterns in E- and H-plane are shown in FIGS. 17-18 for the feed horn and its telescoping waveguides, at 35.75 GHz, at $\varphi=0°$ (FIG. 17) and (b) $\varphi=90°$ (FIG. 18). In this example, the calculated directivity of 20.82 dBi is comparable to the measured one of 20.95 dBi. The calculated gain of 20.52 dBi is comparable to the measured one of 20.40 dBi. The calculated and measured reflection coefficients of the feed with its subreflector and three struts is shown in FIG. 19 after deployment.

Figure 20:
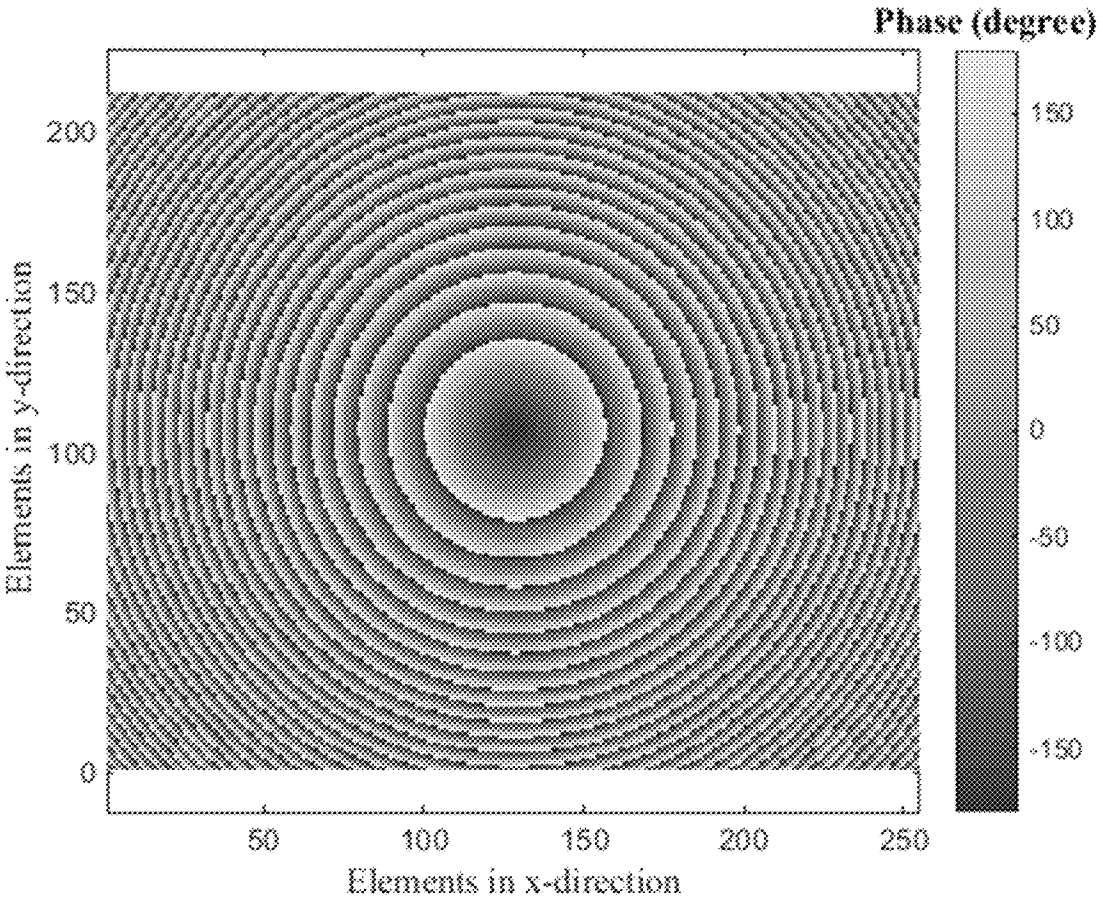
FIG. 20 illustrates an exemplary wrapped phase delay of all elements of the reflectarray.
Figure 21:
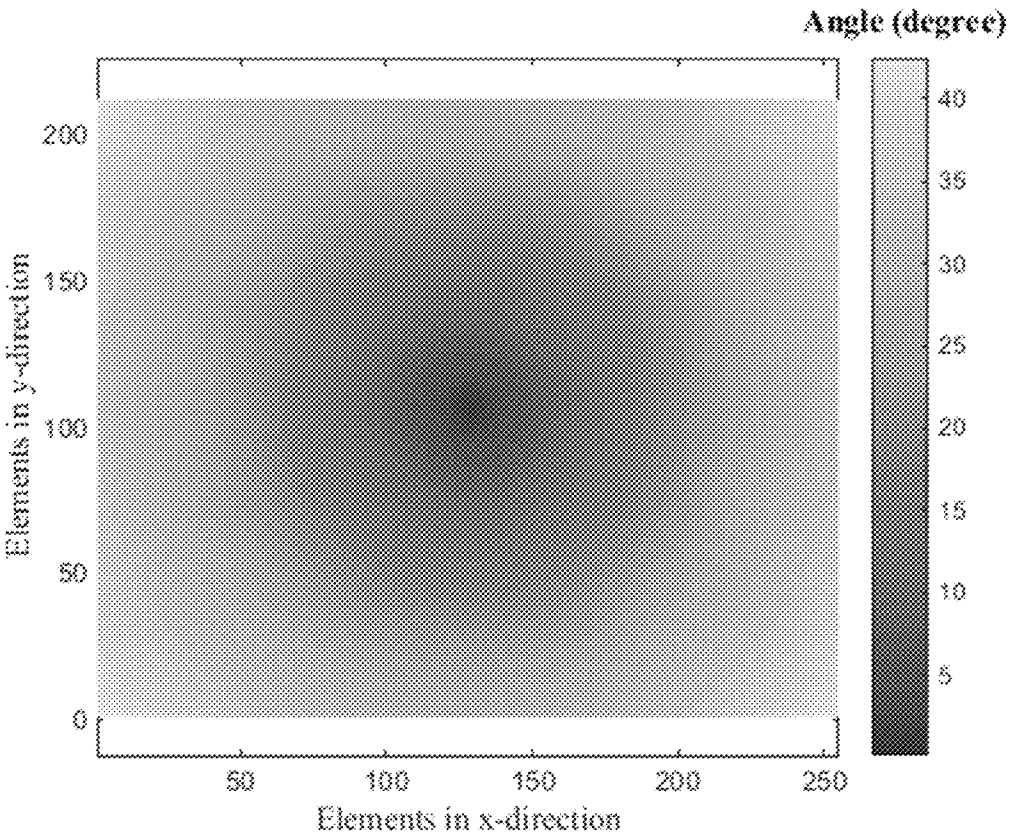
FIG. 21 illustrates an exemplary angle of incidence of all elements of the proposed reflectarray.

FIG. 20 illustrates an exemplary wrapped phase delay of all elements of the reflectarray. FIG. 21 illustrates an exemplary angle of incidence of all elements of the proposed reflectarray. The antennas described in the present disclosure use as a unit cell a variable size square patch microstrip element. The required phase of each element is determined using the reflectarray design equation:

$$\phi_i - k_0(R_i + \bar{r}_i \cdot \hat{r}_o) = 2\pi N$$

where $\varphi_i$ is the required transmission-line phase delay of the ith element, $R_i$ is the distance from the focal point to the ith array element, $\bar{r}_i$ is a vector from the center of the array to the ith array element, $\hat{r}_o$ is a unit vector in the main beam direction, and $k_0$ is the free space wavelength.

Since the f/D ratio in this example is small, the angle of incidence needs to be taken into account to maximize the antenna efficiency. The central element directly below the feed has an incidence angle of 0°, whereas those elements at the edges of the reflectarray have larger angles of up to 45° (see FIG. 21). The angles for the other elements have values between these extremes.

Figure 22:
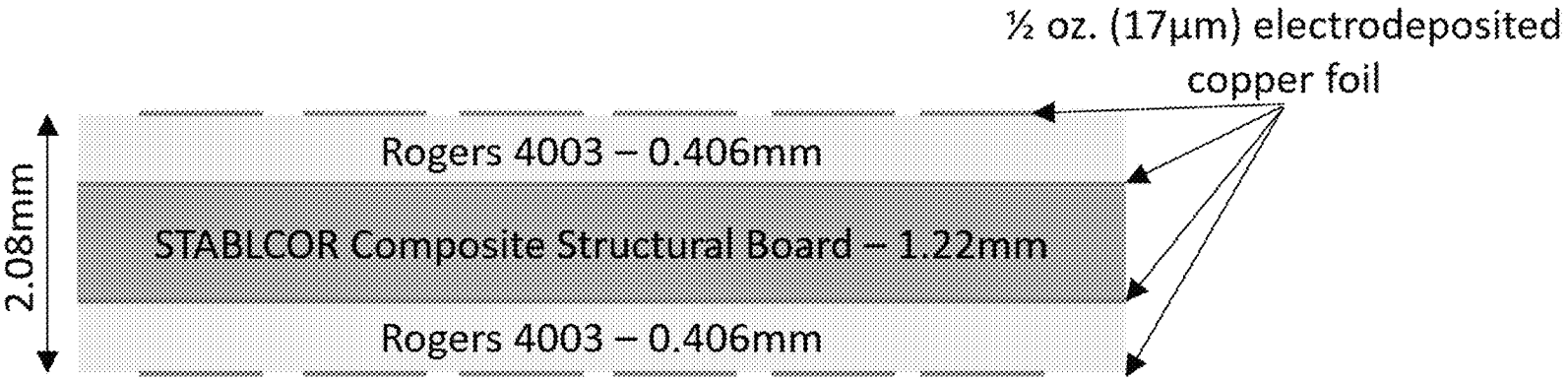
FIG. 22 illustrates an exemplary composite multilayer for the reflectarray panels.

In some embodiments, the reflectarray patch spacing is set to 3.86 mm, i.e. 0.46 wavelengths. In some embodiments, the 14 deployable reflectarray panels consists of two 0.813 mm-thick Rogers® RO4003C™ ($\varepsilon_r$=3.55 and tan$\delta$=0.0027), printed with the reflectarray patches on one side, co-cured with a central core of graphite composite. The central layer is a 0.589 mm-thick STABLCOR® layer providing the required flatness over temperature. The cross section of the reflectarray panels is illustrated in FIG. 22. The surface flatness of these panels was measured to be within ±0.02 mm. In some embodiments, the RO4003C™ can have a thickness of 0.406 mm each, and the STABLCOR® can be 1.22 mm thick. The symmetrical panel with a thickness of 2.08 mm results in a very high structural rigidity. In some embodiments, the RO4003C™ circuit boards can be 16 mils, and the central layer can be 32 mils. In some embodiments, the central layer can be a M55J composite structural board. The two Rogers® RO4003C™ layers are printed with the reflectarray patches on the opposite side of each other to provide structural rigidity over larger temperature range, as the symmetrical structure avoids large temperature gradients. The person of ordinary skill in the art will understand that, in other embodiments, different materials may be used for the panel multilayer, or the same materials as in FIG. 22 may be used, but with different thicknesses. In some embodiments, the layers may comprise hydrocarbons with fiberglass, or copper, for example electrodeposited copper foil.

Figure 23:
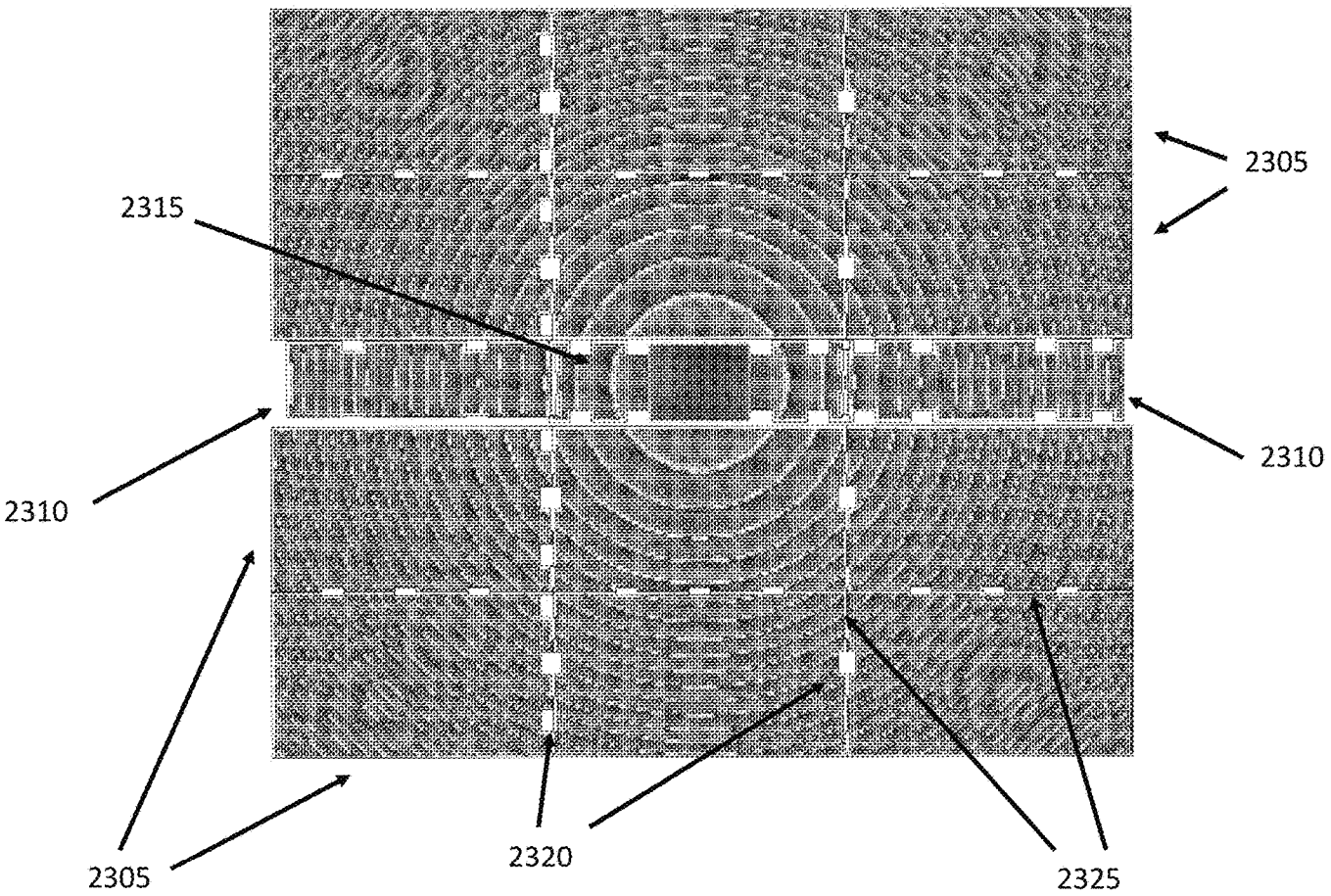
FIG. 23 illustrates an exemplary reflectarray comprising 15 panels.

FIG. 23 illustrates an exemplary reflectarray comprising 15 panels. In this embodiment, the deployable reflectarray consists of 12 201×348 mm$^2$ panels (2305). Six of these 12 panels are folded on each of two sides of the CubeSat large side. The large sides of a CubeSat are about 300×200 mm$^2$. These panels are all separated by about 0.254 mm gaps, a negligible distance compared to the unit cell size. The two remaining deployable panels (2310) fold on top of the fixed panel (2315) on the bus and deploy thanks to two spring loaded hinges. Custom hinges are specifically designed and developed for the reflectarray described in the present disclosure to meet the deployment accuracy required at the Ka-band, and to minimize the gap between each panel. FIG. 23 illustrates several hinges connecting the panels (2320).

Figure 24:
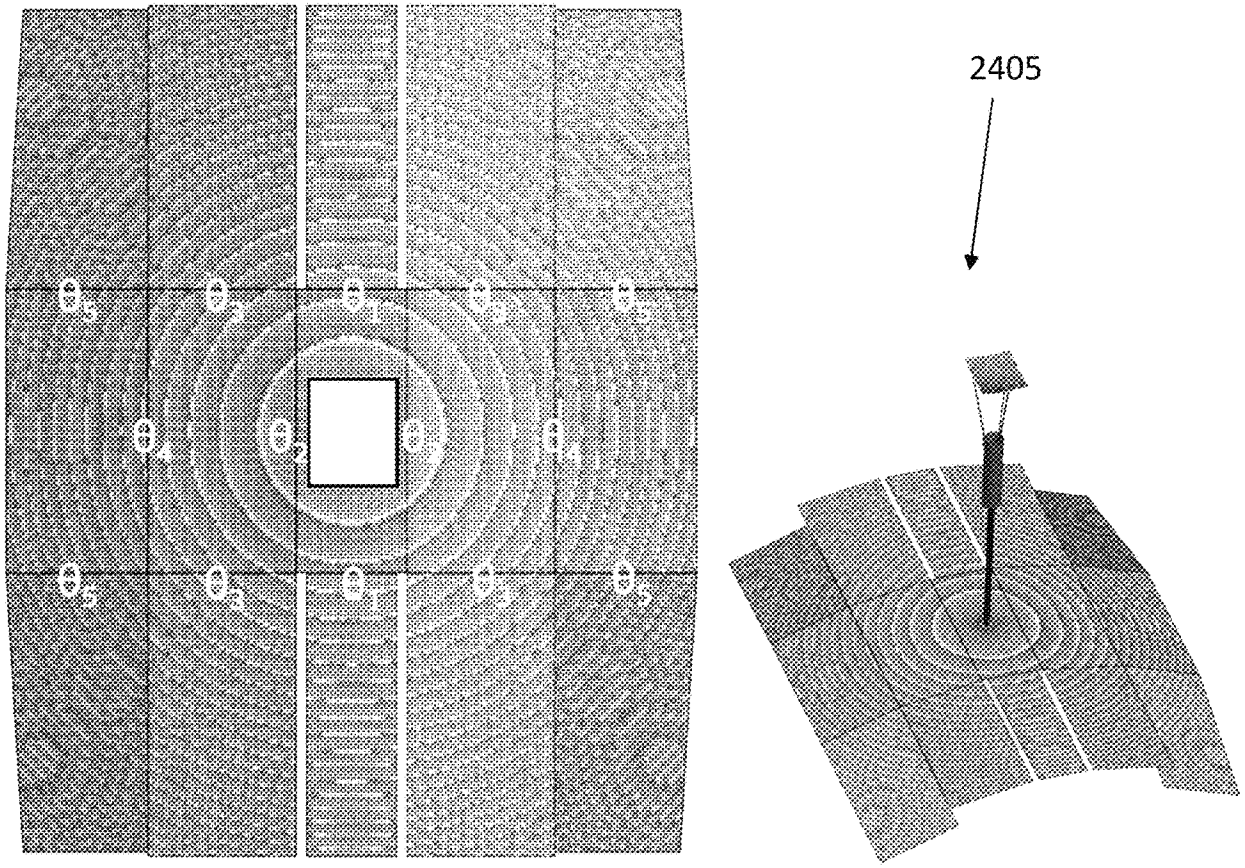
FIG. 24 illustrates inclination angles between adjacent panels.

In some embodiments, the inclination angle between adjacent panels in FIG. 24 can be less than 0.10 degrees, or 0.04 degrees. For example, in some embodiments, the required angles (relative to the horizontal, ideally flat, reflectarray surface) to achieve deployment for the operation at the Ka-band may be ±0.04 degrees for $\theta_1$, $\theta_2$, $\theta_3$, and $\theta_4$, and ±0.10 degrees for $\theta_5$. FIG. 24 also illustrates an example of an exaggerated deployment error (2405), where several panels are misaligned relative to each other, instead of forming a flat, or very nearly flat, reflectarray surface.

Figure 25:
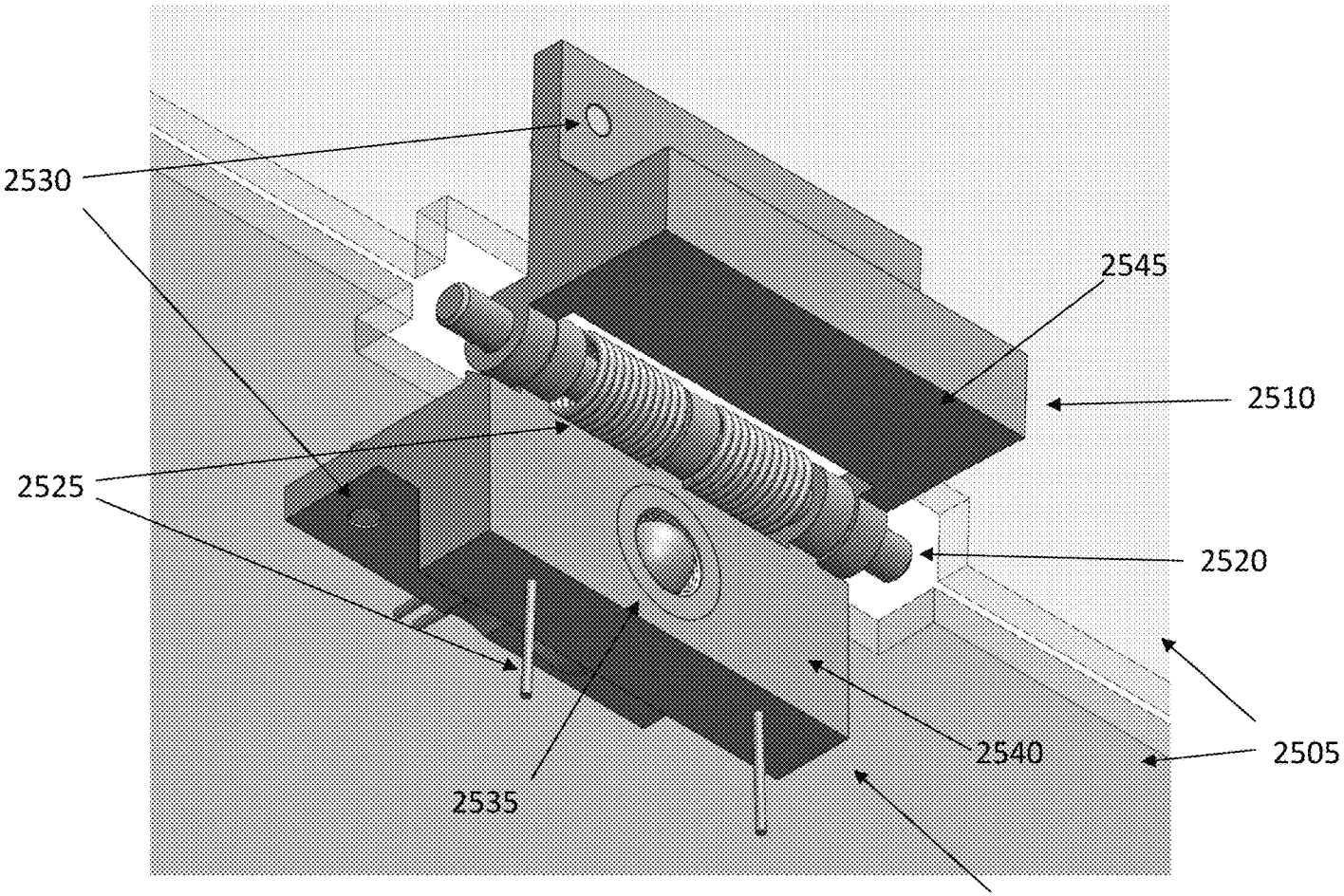
FIG. 25 illustrates custom made hinges with adjustability features, according to an embodiment of the present disclosure.

FIG. 25 illustrates custom made hinges with adjustability features, according to an embodiment of the present disclosure. The adjustable end-stop comprises a fine-thread ball-end set screw that rests against a flat surface in the deployed configuration, allowing adjustments of the deployment angle within few hundredths of a degree. In FIG. 25, two adjacent panels are illustrated (2505), while at approximately 90° to each other, for example during deployment. In FIG. 25, one leaf (2510) of the hinge is attached to one panel, while the other leaf (2515) is attached to the adjacent panel. A hinge pin (2520) connects the two leaves, allowing their rotation relative to each other, which in turn allows the panels to rotate relative to each other. One or more springs (2525) can provide a stiffness force as required. Alignment pins (2530) can provide the alignment between the hinge leaves and the corresponding panels. In some embodiments, a middle hinge portion can have two surfaces (2545,2540) perpendicular to the two leaves (2515,2510). Within this middle portion, an adjustable end-stop can set a deployed position. This end-stop can comprise a fine-thread ball-end set screw (2535) that rests against the flat surface (2545) in the deployed configuration. By adjusting the position of this set screw (2535), the deployed angle of the hinge can be adjusted in fine increments.

FIG. 23 also illustrates gaps and cutouts between panels in the reflectarray. The cutouts are there to accommodate the volume of the hinges, in stowed position, that allow deployment of the panels, as required to meet the deployment accuracy. The gaps are designed to fit in the CubeSat bus. These gaps and cutouts can result in a gain loss of 0.15 dB.

For a surface having a root-mean-square (RMS) deviation from a plane of 0.25 mm, Ruze's equation predicts a 0.6 dB loss. In some embodiments, the measured surface flatness of the reflectarray panel is within ±0.1 mm, which translates into a 0.1 dB loss.

A theoretical analysis was performed to derive the deployment accuracy required to maintain satisfactory performance. In this analysis, five angles were defined as shown in FIG. 24. The dependency between angles was also taken into account. For instance, if $\theta_2$ is not null, which means the corresponding panel was not properly deployed, the deployment of the 12 large panels will be affected. The calculated deployment angle accuracy is summarized as follows: ±0.04 degrees for $\theta_1$, $\theta_2$, $\theta_3$, and $\theta_4$, and ±0.10 degrees for $\theta_5$. These numbers were used as the basis for designing the custom hinges of FIG. 25. With the deployment accuracy summarized above, the predicted gain loss is about 0.33 dB.

Development of new hinges was required to meet the deployment accuracy of the reflectarray panels. The middle hinge of the three hinges that comprise a single hinge line has an adjustable end-stop that sets its deployed position. This end-stop comprises a fine-thread ball-end set screw that rests against a flat surface in the deployed configuration. By adjusting the position of this set screw, the deployed angle of the hinge can be adjusted in fine increments. This adjustability relaxes the requirements on the accuracy of the assembly process; the deployed hinge angle can be measured after assembly, and adjusted to meet the deployed hinge angle requirement. This process allows the deployed planarity of the array to be limited not by the assembly process (as it was with previous hinge design), but by the ability to measure and adjust the hinge angle. Additionally, if the ball-end set screw and the flat surface against which the set screw rests are made of similarly hard materials, this design also achieves better deployment repeatability compared to existing hinge designs.

The one-sided hinges described in the present disclosure allow the panels to fold in such a way that when folded, the gap between the panels can be arbitrarily small. This process allows folding of the panels with little wasted volume in the packaged configuration. In other words, the packaging efficiency is much higher than previously possible, by a factor of about two. This is critical to fit in a 6U-class CubeSat.

Additionally, the hinge attachment to the panel is also improved compared to previous iterations, which use a double-sided hinge in which the panel is affixed using an epoxy adhesive. The double-sided hinges can increase the stowed volume and allow the panel position to shift within the hinge, due to viscoelastic effects. By contrast, the hinges described herein use a combination of alignment pins, metal bolts, low-profile threaded inserts, and an epoxy adhesive to attach the hinges to the panels. The alignment pins ensure good alignment between the hinge and the panel that does not drift over time. The bolts and inserts provide tensile stiffness and strength, and the epoxy adhesive distributes loads over the footprint of the hinge and avoids stress concentrations. The folding pattern avoids panel interference during deployment, and ensures that the panels do not jam against each other or against the spacecraft bus during deployment. Additionally, the folding pattern facilitates the hinge and panel assembly process, since all of the hinges are attached to the same side of the panels.

A first set of tests was performed to demonstrate the adjustability and the deployment repeatability using two panels only. A faro arm with a laser scan head is used to measure the deployment angle. A deployment accuracy of ±0.05 degree was observed with 158 deployments. In addition, deployment accuracy was tested on one side of the CubeSat (i.e. 6 panels). The deployment accuracy achieved using the custom made hinges is well within the angle requirements summarized above.

Figure 26:
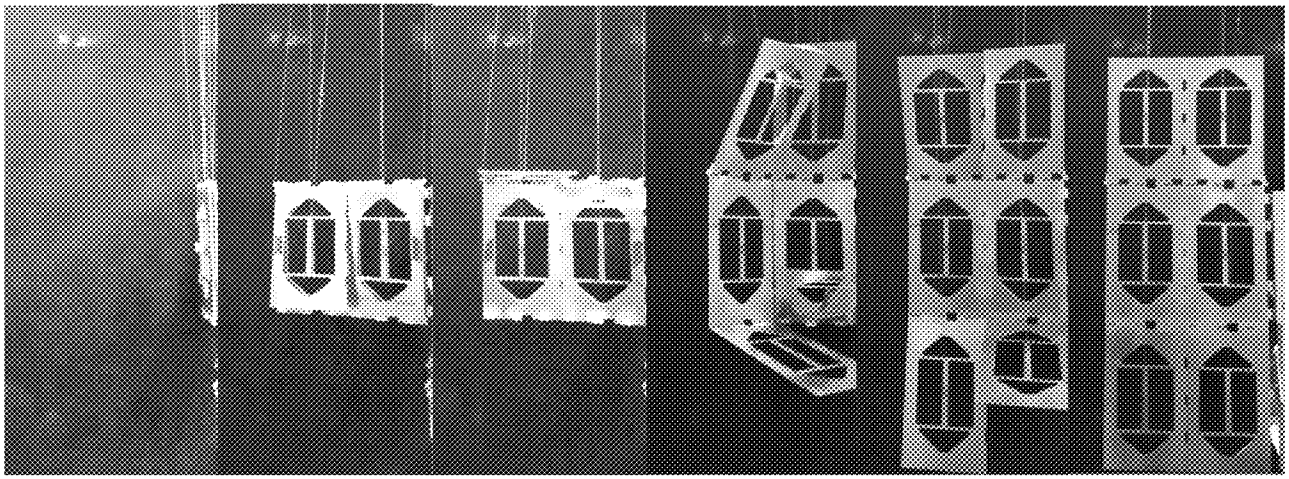
FIG. 26 illustrates a 6-panel deployment with an offloading mechanism to simulate weightless condition.

In some embodiments, the deployment of the antenna is sequential. In a first step, using a burn wire release mechanism, the two sets of six panels are deployed. Subsequently, the two single panels are deployed using a second burn wire. In a next step, the feed deployment occurs. The deployment of one set of the six panels is shown in FIG. 26. An offloading mechanism was employed, in the example of FIG. 26, to reproduce the zero gravity conditions that would occur in a deployment in a space environment.

Figure 27:
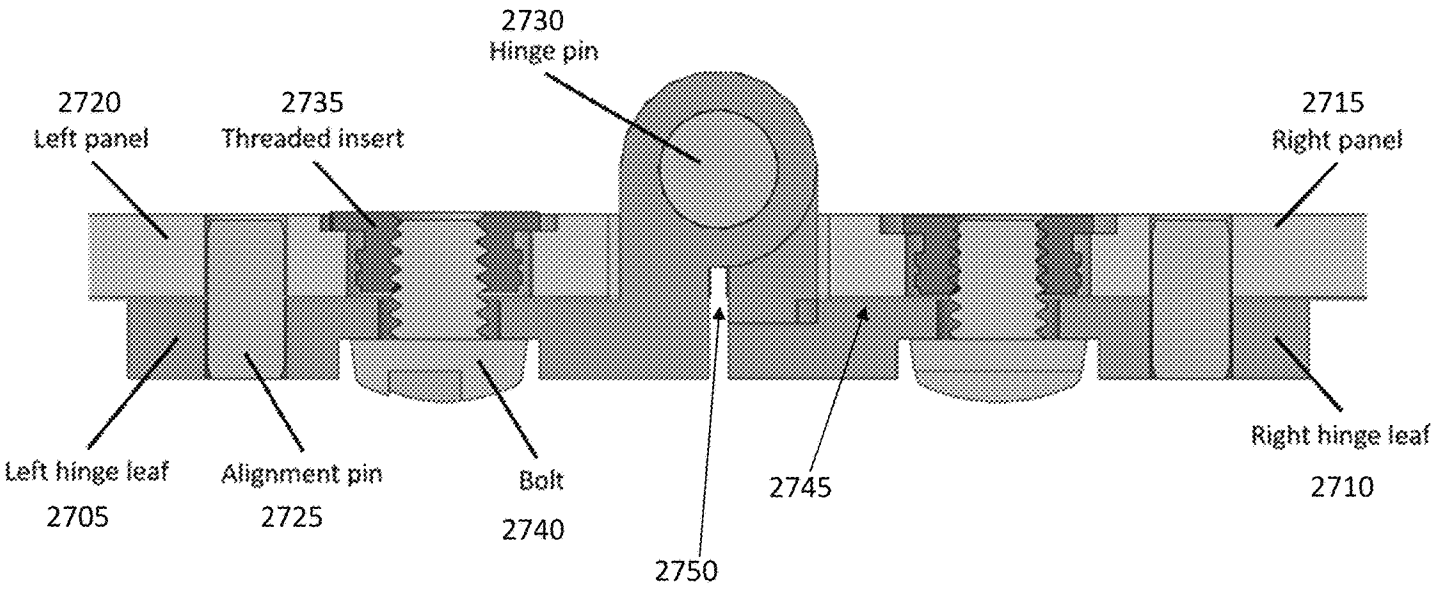
In FIG. 27, an exemplary hinge is illustrated, attached to two adjacent panels.

In FIG. 27, an exemplary hinge is illustrated, attached to two adjacent panels. In FIG. 27, one leaf (2710) of the hinge is attached to one panel (2715), while the other leaf (2705) is attached to the adjacent panel (2720). Epoxy (2745) can be used to attach each leaf to the corresponding panel. A hinge pin (2730) connects the two leaves, allowing their rotation relative to each other, which in turn allows the panels to rotate relative to each other. One or more springs can provide a rotational stiffness force as required. Alignment pins (2725) can provide the alignment between the hinge leaves and the corresponding panels. In some embodiments, fine-thread ball-end set bolts (2740) can be inserted in a threaded insert (2735) to attach each leaf to the adjacent panel, instead of, or in combination with, the epoxy compound. In some embodiments, the two surfaces between the two leaves of the hinge can be offset by a fine-thread ball-end set screw (2750) as described in FIG. 25.

Figure 28:
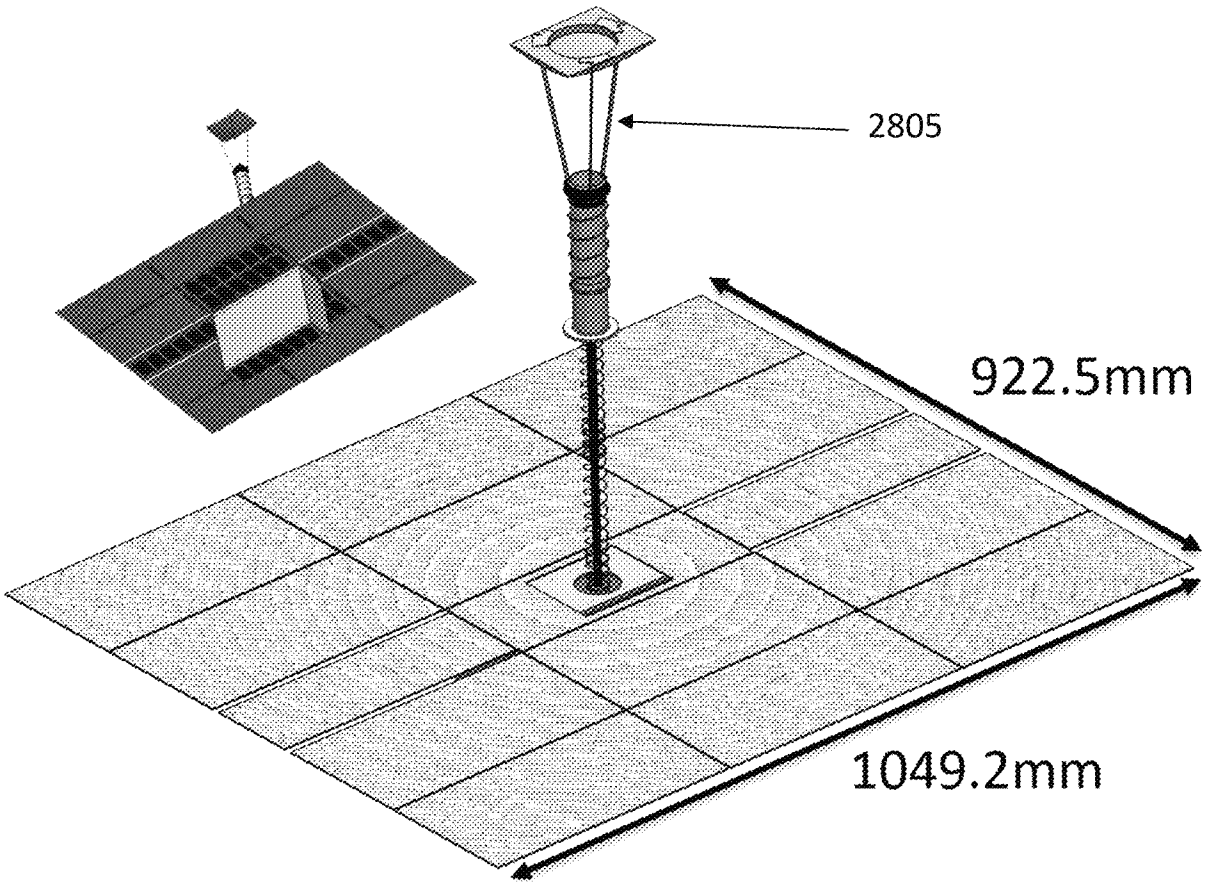
FIG. 28 illustrates an exemplary deployed reflectarray.

In some embodiments, as illustrated in FIGS. 5 and 28, three stainless steel struts (2805) are employed to maintain a good alignment of the subreflector (for example, ±0.2 mm in the z axis and ±0.1 mm in the x and y axis). The struts affect the peak gain, the cross-polarization and the sidelobe levels. In some embodiments, the three rectangular cross-section struts have lateral dimensions of 1.0 mm and 4.0 mm. The struts result in an overall increase in sidelobe level (about 3 dB) and reduce the peak gain (by about 0.3 dB at 35.7 5GHz). The struts can be located and designed to ensure the panels can fit on either side of the spacecraft; this enables a compact 6U-class antenna design.

The feed horn, combined with the three struts, the subreflector, and three telescoping waveguides, can be modeled as a MoM/MLFMM object. A waveguide port is employed to excite the MoM/MLFMM object. The horn and telescoping waveguides are defined as one object using two piecewise linear body of revolution objects, one for the interior and one for the exterior. These two objects are combined in a scatterer cluster and define the horn geometry. A scatterer cluster including the feed horn and waveguides, the three struts and the subrefector, is created and used as a MoM/MLFMM object. In some embodiments, the following parameters can be calculated at 37.75 GHz: directivity of 48.5 dBi; gain of 47.8 dBi and loss of 0.7 dB. The loss equals the directivity minus the gain. The deployable reflectarray can achieve, for example, a gain of 47.8 dBi, which translates into a 42% efficiency.

The present disclosure describes a high gain antenna for CubeSats for telecommunication and radar applications. The present disclosure describes a highly constrained deployable reflectarray antenna for 6U-class CubeSat. For example, the antenna can be used in the Ka-band.

The Ka-band high gain reflectarray antenna employs Cassegrainian optics to accommodate a deployment mechanism that stows the reflectarrat panels and feed assembly into a highly constrained volume. Despite these mechanical constraints, the antenna demonstrates excellent performance at 35.75 GHz: e.g. a gain of 47.8 dBi and an efficiency of 42%.

Figure 29:
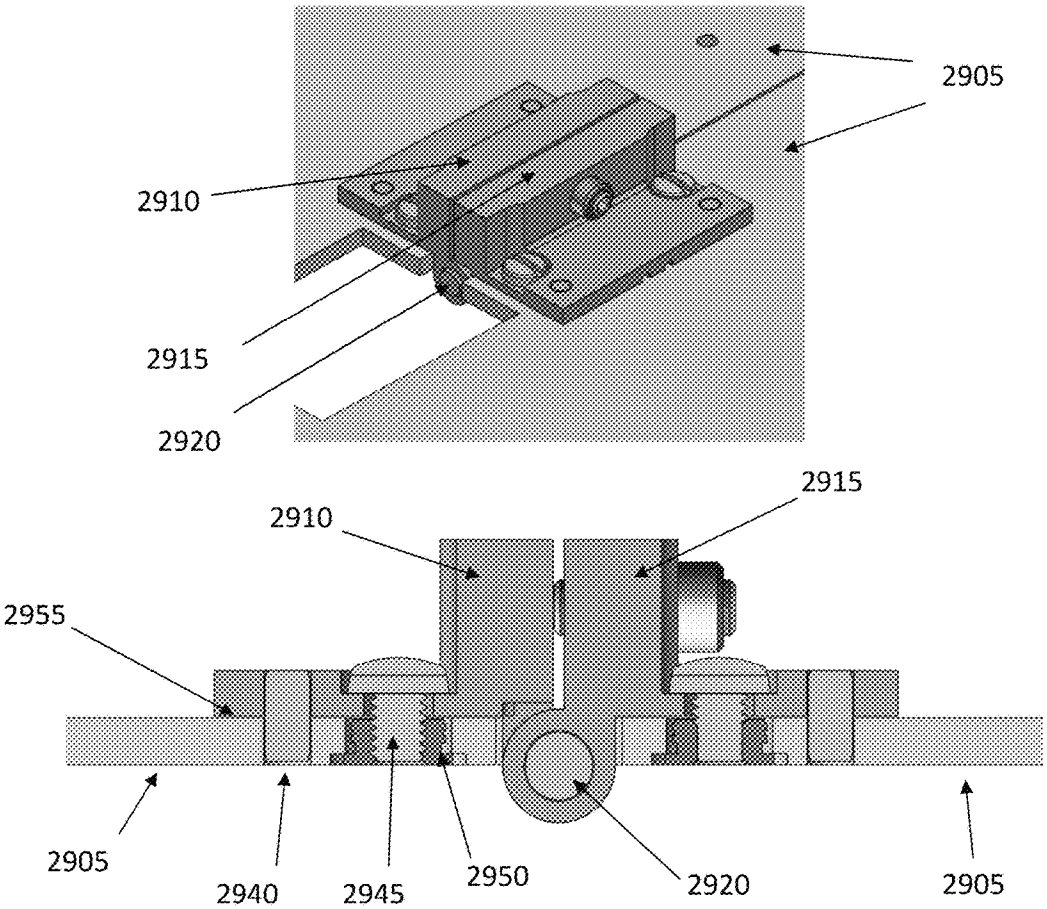
FIGS. 29-31 illustrate an exemplary hinge design.
Figure 30:
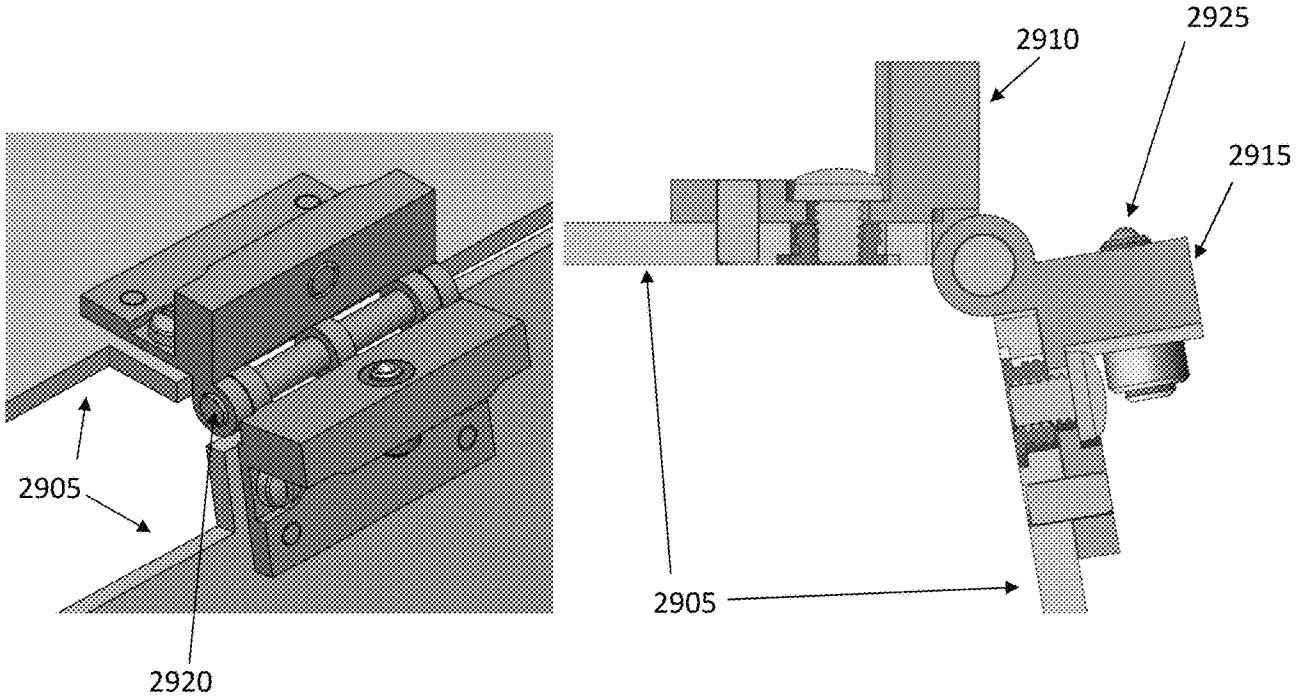
Figure 31:
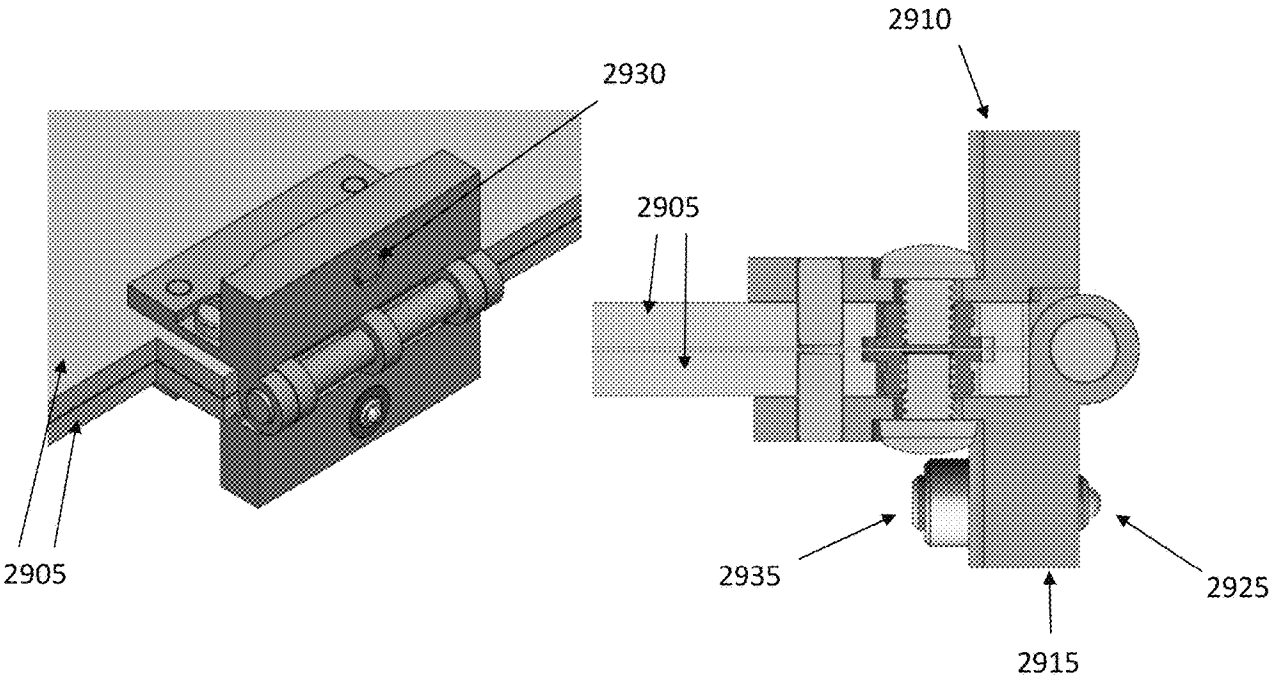

In some embodiments, the hinges connecting the reflectarray panels, which are used to deploy the panels from the stowed configuration to the deployed configuration, are as illustrated in FIGS. 29-31. FIG. 29 illustrates two adjacent reflectarray panels (2905), fully unfolded, FIG. 30 illustrates the two adjacent reflectarray panels in a partially unfolded state, and FIG. 31 illustrates the two adjacent reflectarray panels fully folded. FIGS. 29-31 show both isometric views, and cross-sectional views of the hinges.

FIGS. 29-31 illustrate a first leaf (2910) fixed to one panel, and a second other leaf (2915) fixed to the adjacent panel. The two leafs or portions of the hinge are interconnected using a hinge pin (2920). The pin allows the leafs to rotate during deployment. One or more springs can be attached to the rotation mechanism, to provide stiffness and an unfolding force.

When fully unfolded, a ball (2925) presses against a flat end stop (2930), thereby dictating the final unfolded angle between the panels. The location of the ball (2925) with respect to the leaf (2915) can be adjusted by turning a fine-thread set screw (2935). The ball is attached to the end of the fine-thread set screw in a manner that allows the ball to freely roll, like a ball-point pen. Changing the location of the ball with respect to the leaf (2915) allows for fine control of the final unfolded angle between the panels, and allows for the correction of any manufacturing or assembly errors. For example, the reflectarray can be assembled and the balls of each hinge can be adjusted to the correct angle between panels, before folding for stowage and launch. The reflectarray can thereafter deploy in orbit, with the hinges adjusted to the correct angle of deployment.

The leafs can attached to the panels using three parallel methods. For instance, the leaf (2910) can be attached to the panel (2905) using an alignment pin (2940), an externally threaded bolt (2945) that threads into an insert (2950), and an epoxy adhesive between the leaf and the panel (2955). The insert has a flange that catches a counterbore on the panel, thus providing strength in tension and peel. The alignment pin precisely positions the leaf with respect to the panel.

Figure 32:
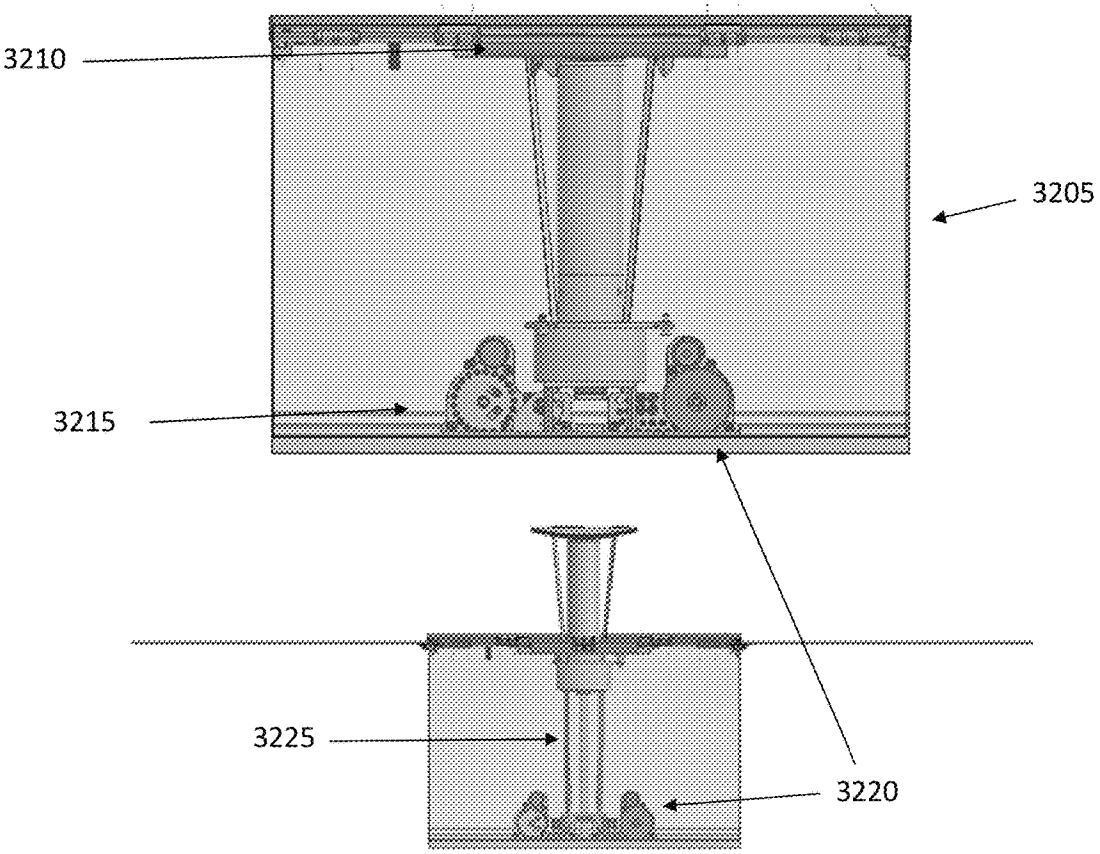
FIG. 32-33 illustrate stages of deployment.
Figure 33:
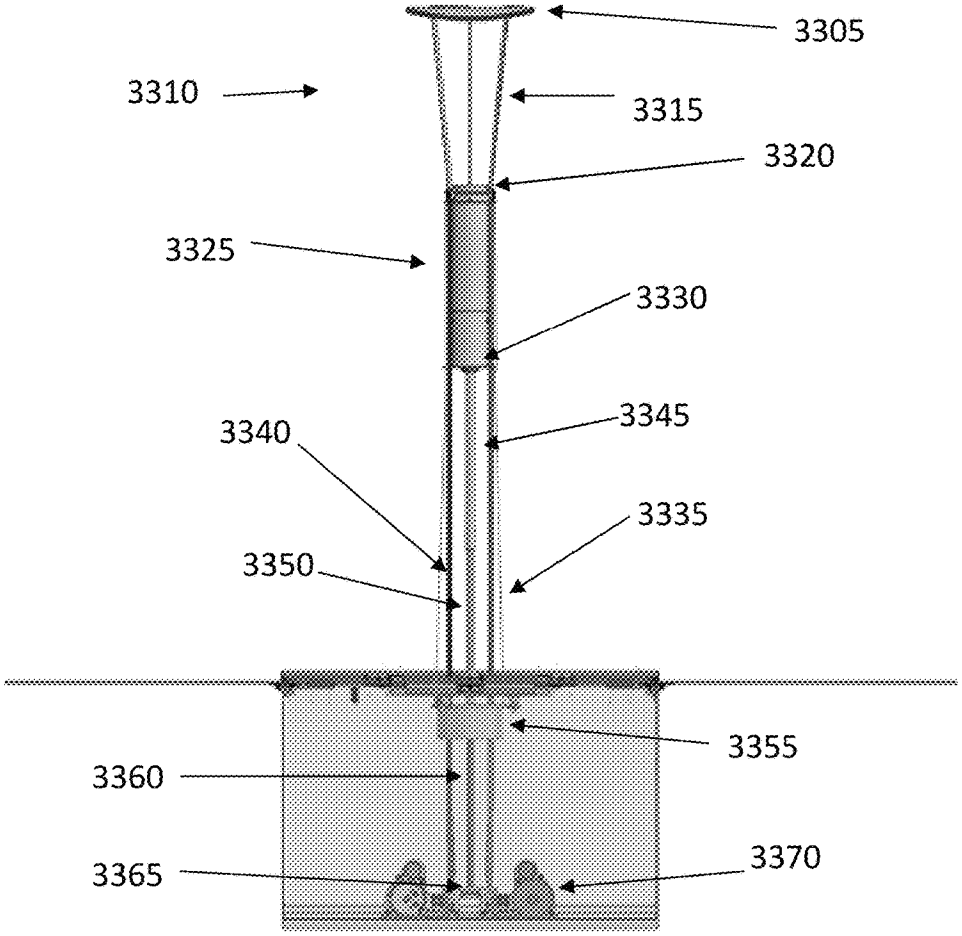

FIGS. 32-33 illustrate stages of deployment: the entire assembly in the stowed configuration (3205), to stow in a volume having a 220 cm height to fit in a 6U CubeSat. The subrflector and the top of the horn are near the top of the CubeSat (3210), while the bottom of the horn and the deployment guide plate are near the bottom of the CubeSat (3215).

The tape deployers (3220) roll out tape, pushing the whole assembly upwards. For example, one tape deployer on each side can be used. The guide plate reaches the underside of the CubeSat surface, and is located in place by kinematic mounting features. The tape deployers continue to roll out tape until the assembly is fully deployed.

In FIG. 33, the secondary reflector assembly (3310) comprises a subreflector (3305), struts (3315) and a collar (3320). FIG. 33 also illustrates the horn (3325), a waveguide/horn threaded insert (3330), quartz cables (3335) to set the deployment position, a first waveguide portion (3345), a second waveguide portion (3350), a third waveguide portion (3360), tape for driving the deployment (3340), a deployable guide structure (3355), a base plate (3365), and the deployment drive mechanism (3370).

The feed comprises a secondary reflector assembly, horn, waveguide, and deployment driving mechanisms. A deployable guide structure helps to guide the deployment mechanisms, and kinematically mounts them at the top. The base plate also has guide features to guide the tapes. The secondary reflector assembly has a sub-reflector attached by struts to a collar, which encircles the horn. This allows the assembly to telescope along the horn. The secondary reflector collar also includes features for locating cables, which precisely places the sub-reflector and horn. The secondary reflector also has mating features for the tapes from the deployment driving mechanisms.

The horn is primarily an RF component, which connects to the secondary reflector assembly at the top, and the waveguide at the bottom. The horn has a locate slot in it to keep the sub-reflector assembly aligned as it telescopes along the horn.

The waveguide comprises three precision tubes, each tube telescoping within the other. The waveguide can be attached to the horn via a threaded insert in the horn, allowing the waveguide to be removed from the horn. At the opposite end of the waveguide is a flange, bonded to the waveguide. To ensure a good bond and precise fit, the flange can have a hole the exact diameter of the waveguide, with slots for bonding material to fill. The waveguide connects to the base plate. The deployable tapes go through this base guide plate which sets their initial position. The deployment mechanism comprises two motorized tape deployers, which deploy a tape spring wound about a spool. The deployable guide structure guides the tapes near the top of the CubeSat, increasing overall stiffness. The horn also has a guide feature on it. Quartz cables which run from the deployable guide structure to the collar can precisely set the position of the secondary reflector assembly and the horn.

Figure 34:
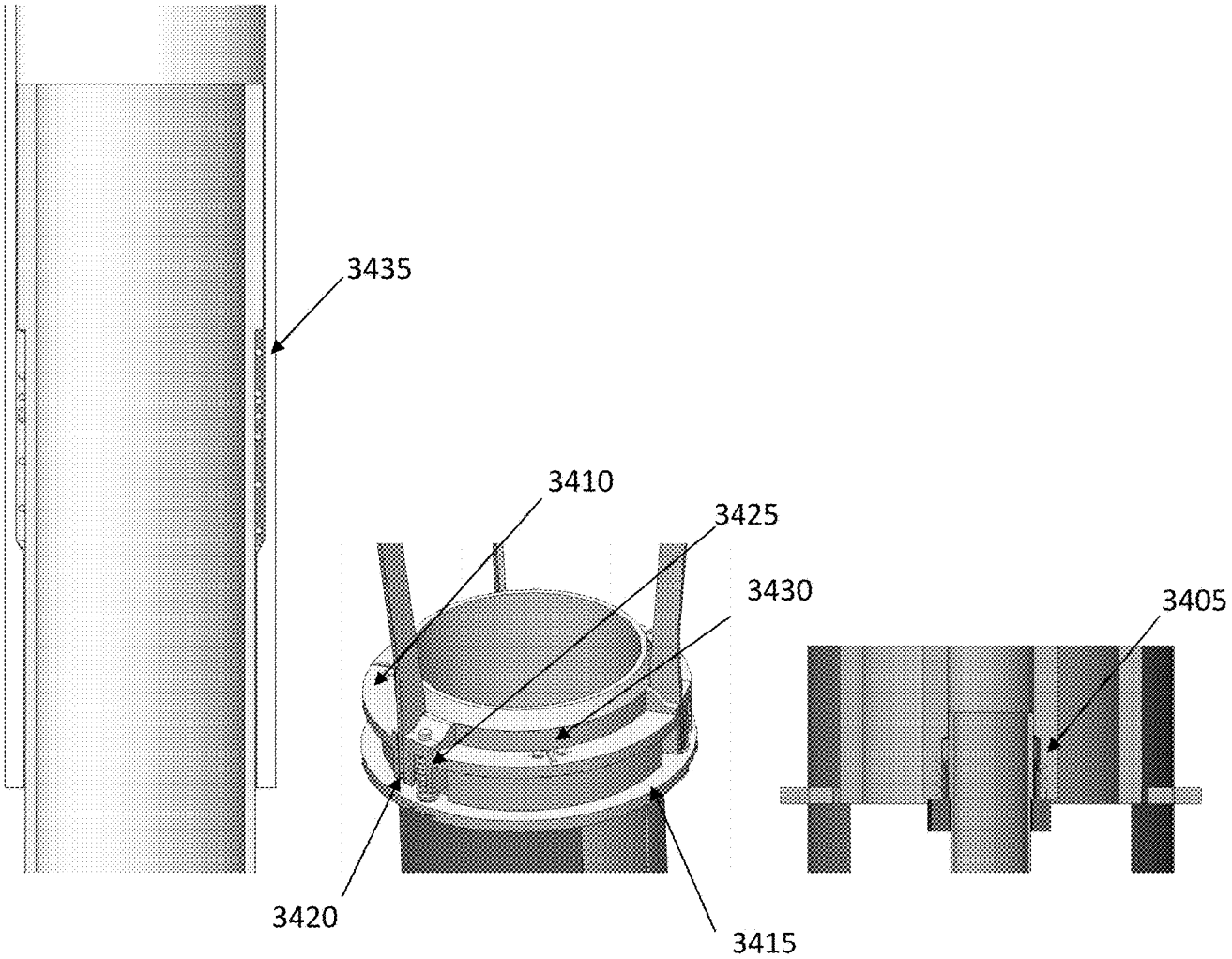
FIGS. 34-36 illustrate additional details of the reflectarray structure.
Figure 36:
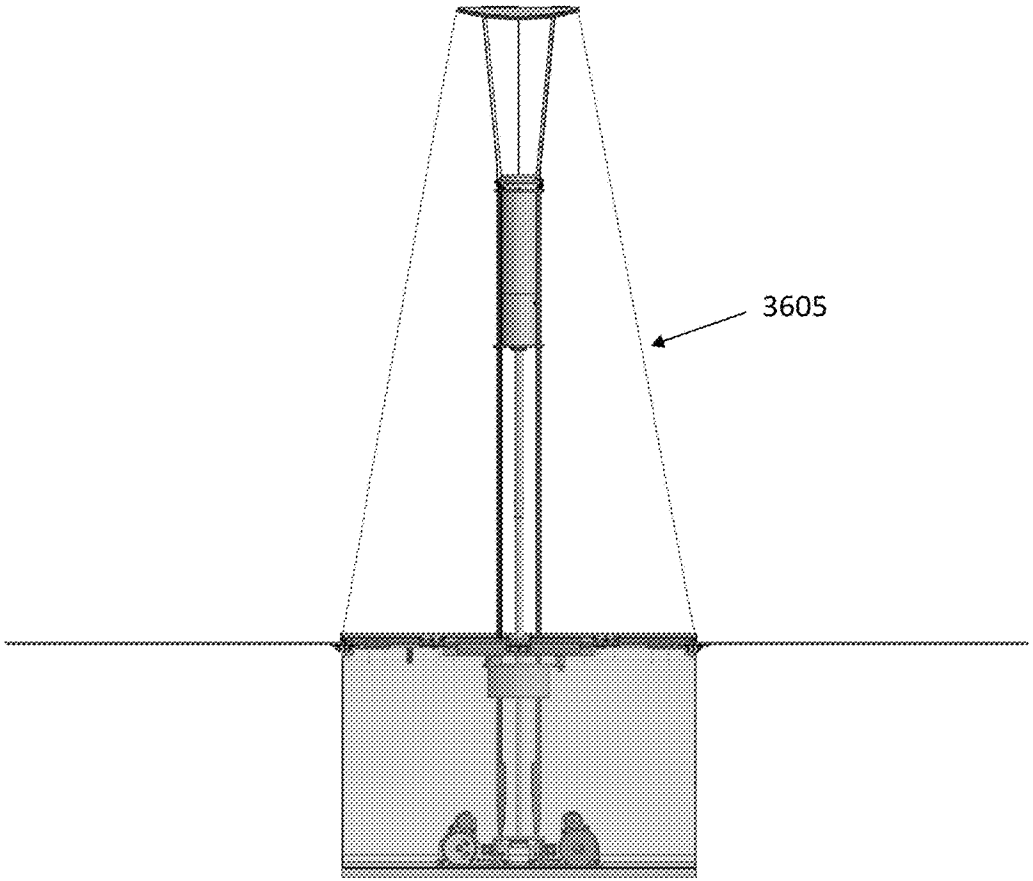

FIGS. 34-36 illustrate additional details of the reflectarray structure: the threaded insert between waveguide and horn (3405), top collar (3410), bottom collar (3415), strut bonding slot (3420), spring for compliance (3425), cable guides (3430), a vertical locating compression spring (3435) between two sections of waveguide. The two portions of waveguide have a compression spring in between them. A compression spring keeps the first waveguide preloaded against the bottom of the insert connecting it to the horn, ensuring precise positioning for RF.

The secondary reflector assembly collar can comprise two pieces. The bottom collar is bonded to the struts (via the strut bonding slot), and the top collar is bonded to the tapes (via a tape mounting feature). A compression spring between the top and bottom collar maintains compliance, which ensures the tapes only provide an upward force and do not position the sub reflector. This structure ensures the deployed position is controlled by the quartz cables instead of the tapes. In other words, the tapes drive the deployment while the cables control the precise positioning. The collar comprises holes or guides for the quartz cables, where the cables are located to precisely position the collar, and hence the sub-reflector and horn. The holes have a sufficient radius to prevent damage to the cables.

FIG. 35 illustrates kinematic mounts (3505), the deployable guide plate (3510), tape guide slots (3515), tape mounting feature (3520) and horn (3525). The kinematic mounting features ensure the deployment guide structure always deploys to the same position. The kinematic mount comprises three ball contact points on the deployment guide structure, and 3 V-shaped slots on the top of the CubeSat, to provide 6 exact mounting points. The mounting features in the collar and tape guide slot in the horn are shaped like a crescent, due to volume constraints. The tape guide slots in the deployable guide structure and the base plate are shaped like a crescent cut out of a box. This ensures that the tape can be in both the flat state and in the curved state. The tape is in a curved state when deployed, but in a flat state when it comes out of the roller. Thus to get all parts to consume as little volume as possible, both of these guides accommodate both flat and curved states. The guide slots may be curved slots in the horn.

In some embodiments, as illustrated in FIG. 36, the quartz cables (3605) run to the sub-reflector instead of the collar. This results in the secondary reflector assembly dictating the position of the horn, versus the horn dictating the position of the secondary reflector. This embodiment produces a more accurate positon of the secondary reflector, but may lead to a less precise horn placement.

The present disclosure describes: utilizing tape springs rolled up on a spool to deploy a feed; a multi-stage telescoping waveguide; a compression spring within the walls of the waveguide, to precisely locate the waveguides position; a design that precisely locates the secondary reflector assembly, and allows location of the secondary reflector assembly to position the location of the horn; a removable telescoping waveguide, which can be detached from the horn via a threaded flange; struts in the sub-reflector to ensure the panels can fit on either side of the S/C (this enables a compact 6U design); a deployable guide structure for an antenna feed deployment to increase stiffness; horn and tape guide structure with guide slots to increase stiffness.

In some embodiments, the deployment tape such as (3530) in FIG. 35 can be a spring steel carpenters tape. However, other types of materials could be used as tape, such as Astroquartz®, carbon fiber, spring steel, steel, and beryllium copper.

The person of ordinary skill in the art will note that the increased precision of deployment allowed by the present disclosure creates an operational opportunity to work in the Ka-band or higher frequency bands, while methods of deployment using less precise hinges and mechanism would only operate at bands requiring a lower surface accuracy, such as the X-band. In some embodiments, the trilayer of the reflectarray panels may comprise external layers with a conductive material, and a central layer acting as a structural board.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The references in the present application, shown in the reference list below, are incorporated herein by reference in their entirety.

REFERENCES

[1] C. Boshuizen, J. Mason, P. Klupar and S. Spanhake, "Results from the Planet Labs Flock Constellation", 28th Annual AIAA/USA Confernece on Small Satellites, August 2014.

[2] C. Underwood, S. Pellegrino, V. Lappas, C Bridges, J. Baker, "Using CubeSat/micro-satellite technology to demonstrate the Autonomous Assembly of a Reconfigurable Space Telescope (AAReST)", Acta Astronautica 114(2015) 112-122, April, 2015.

[3] E. Peral, S. Tanelli, Z. S. Haddad, G. L. Stephens, and E. Im, "RaInCube: a proposed constellation of precipitation profiling Radars In Cubesat,"*AGU Fall Meeting,* San Francisco, December 2014.

[4] N. Chahat, R. Hodges, J. Sauder, M. Thomson, E. Peral, and Y. Rahmat-Samii, "CubeSat deployable Ka-band mesh reflector antenna development for Earth science missions," *IEEE Trans. Antennas Propag.,* vol. 64, no. 6, pp. 2083-2093.

[5] N. Chahat, J. Sauder, M. Thomson, R. Hodges, and Y. Rahmat-Samii, "Deep Space Network telecommunication CubeSat deployable Ka-band mesh reflector antenna," *IEEE Antenna Propag. Magazine,* under review, 2016.

[6] R. E. Hodges, N. Chahat, D. J. Hoppe, J. D. Vacchione, "The Mars Cube One deployable high gain CubeSat antenna," *IEEE Antenna Propag. Magazine,* under review, 2016.

[7] R. Hodges, D. Hoppe, M. Radway, and N. Chahat, "Novel deployable reflectarray antennas for CubeSat communications", *IEEE MTT-S International Microwave Symposium* (*IMS*), Phoenix, Ariz., May 2015.

[8] N. Chahat, T. Reck, C. Jung-Kubiak, T. Nguyen, R. Sauleau, and G. Chattopadhyay, "1.9 THz multi-flare angle horn optimization for space instruments," *IEEE Trans. Terahertz Science Technology,* vol. 5, no. 6, pp. 914-921, November 2015.

What is claimed is:

1. A structure comprising:

a housing;

a plurality of reflectarray panels configured to deploy from a folded position to a deployed position, the deployed position for the reflectarray panels forming a reflectarray antenna;

a telescoping waveguide comprising at least a first telescoping waveguide section, and a second telescoping waveguide section configured to extend away from the first telescoping waveguide section;

a horn attached to the telescoping waveguide by a threaded insert, the horn comprising curved slots;

a subreflector attached to the horn by a plurality of struts bonded to a collar on a top portion of the horn;

at least one tape deployer driving deployment of the telescoping waveguide, horn and subreflector by extending tape through the curved slots; and at least one cable configured to control positioning of the telescoping waveguide, horn and subreflector during deployment.

2. The structure of claim 1, further comprising a plurality of hinges configured to control an angle between adjacent panels of the plurality of reflectarray panels in the deployed position.

3. The structure of claim 2, wherein each hinge of the plurality of hinges comprises:

a first section attached to a first reflectarray panel of the plurality of reflectarray panels;

a second section attached to a second reflectarray panel of the plurality of reflectarray panels, the second reflectarray panel adjacent to the first reflectarray panel, the second section configured to rotate relative to the first section by a hinge pin;

a ball-end set screw threaded in a portion of the second section at a controllable depth, thereby controlling the angle between adjacent panels in the deployed position; and a flat end stop in the first section, configured to act as a stop for the ball-end set screw in the deployed position.

4. The structure of claim 1, wherein the telescoping waveguide further comprises a third telescoping waveguide section.

5. The structure of claim 1, wherein the at least one tape deployer comprises two tape deployers, each tape deployer on either side of the telescoping waveguide.

6. The structure of claim 1, wherein the at least one cable is a quartz cable.

7. The structure of claim 1, wherein the at least one cable is attached to the collar or to the subreflector.

8. The structure of claim 3, wherein the first flat section is attached to the first reflectarray panel by:

an alignment pin through the first flat section and the first reflectarray panel;

a threaded bolt through the first flat section and the first reflectarray panel; and an epoxy layer between the first flat section and the first reflectarray panel.

9. The structure of claim 1, wherein the telescoping waveguide comprises a compression spring between the first telescoping waveguide section and the second telescoping waveguide section.

10. The structure of claim 1, wherein the plurality of reflectarray panels comprises 15 reflectarray panels.

11. The structure of claim 10, wherein each reflectarray panel of the plurality of reflectarray panels comprises a first layer comprising electrodeposited copper foil, a second layer comprising a composite structural board, and a third layer comprising electrodeposited copper foil, the first, second and third layers being co-cured together.

12. The structure of claim 11, wherein the composite structural board comprises fiberglass or graphite.

13. The structure of claim 1, wherein the housing is smaller than $10\times20\times30$ $cm^3$.

14. The structure of claim 1, wherein the reflectarray antenna is configured to operate in the Ka-band.

15. The structure of claim 14, wherein reflectarray antenna is configured to have, at 37.75 GHz, a directivity of at least 48.5 dBi, a gain of at least 47.8 dBi, and an aperture efficiency of at least 42%.

16. The structure of claim 1, wherein the tape comprises steel, beryllium copper, or carbon fiber.

17. The structure of claim 1, wherein the curved slots and the tape are configured to prevent rotation of the subreflector relative to the horn.

* * * * *